US012280975B2

(12) United States Patent
Yamaguchi et al.

(10) Patent No.: US 12,280,975 B2
(45) Date of Patent: Apr. 22, 2025

(54) IMAGE FORMING APPARATUS

(71) Applicant: Brother Kogyo Kabushiki Kaisha, Nagoya (JP)

(72) Inventors: Masatomo Yamaguchi, Inazawa (JP); Yuya Tatematsu, Nagoya (JP); Hironori Takasaki, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 719 days.

(21) Appl. No.: 17/563,410

(22) Filed: Dec. 28, 2021

(65) Prior Publication Data

US 2022/0204299 A1 Jun. 30, 2022

(30) Foreign Application Priority Data

Dec. 29, 2020 (JP) ..... 2020-219779
May 31, 2021 (JP) ..... 2021-091563

(51) Int. Cl.

| | |
|---|---|
| ***H04N 1/04*** | (2006.01) |
| ***B65H 1/04*** | (2006.01) |
| ***B65H 3/06*** | (2006.01) |
| ***B65H 7/04*** | (2006.01) |
| ***B65H 16/10*** | (2006.01) |

(Continued)

(52) U.S. Cl.

CPC ..... *B65H 26/02* (2013.01); *B65H 1/04* (2013.01); *B65H 3/06* (2013.01); *B65H 7/04* (2013.01); *B65H 16/10* (2013.01); *B65H 20/02* (2013.01); *B65H 2511/515* (2013.01); *B65H 2801/06* (2013.01)

(58) Field of Classification Search

USPC ..... 358/304, 1.12, 1.5

See application file for complete search history.

(56) References Cited

U.S. PATENT DOCUMENTS

| | | | |
|---|---|---|---|
| 5,072,306 | A | 12/1991 | Matsumoto et al. |
| 5,564,842 | A | 10/1996 | Kida et al. |
| 6,183,153 | B1 | 2/2001 | Kamoda et al. |

(Continued)

FOREIGN PATENT DOCUMENTS

| | | | |
|---|---|---|---|
| JP | H02-264556 | A | 10/1990 |
| JP | H03-049236 | U | 5/1991 |

(Continued)

OTHER PUBLICATIONS

Oct. 1, 2024—(JP) Notice of Reasons for Refusal—App 2020-219779.

*Primary Examiner* — Cheukfan Lee

(74) *Attorney, Agent, or Firm* — Banner & Witcoff, Ltd.

(57) ABSTRACT

An image forming apparatus includes a housing, a feeding tray capable of being inserted into and pulled out from the housing, a feed roller, and one or more detection units. The feeding tray includes a first accommodation part in which a roll body having a configuration where a sheet-shaped medium is rolled in a roll shape is accommodated and a second accommodation part in which a plurality of sheet-shaped media are accommodated in a state of being stacked. The feed roller feeds a sheet-shaped medium from the feeding tray toward a conveying path. The image forming unit forms an image on a sheet-shaped medium provided in the conveying path. The one or more detection units detect whether a sheet-shaped medium is arranged in a predetermined position in the feeding tray.

23 Claims, 13 Drawing Sheets

(51) Int. Cl.
*B65H 20/02* (2006.01)
*B65H 26/02* (2006.01)

(56) References Cited

U.S. PATENT DOCUMENTS

| | | | | |
|---|---|---|---|---|
| 2014/0291913 | A1 | 10/2014 | Tamura et al. | |
| 2021/0187977 | A1 | 6/2021 | Yasukawa et al. | |
| 2022/0204290 | A1* | 6/2022 | Tatematsu ..... | B65H 16/10 |

FOREIGN PATENT DOCUMENTS

| | | | |
|---|---|---|---|
| JP | H06-072576 | A | 3/1994 |
| JP | H08-169580 | A | 7/1996 |
| JP | H09-086004 | A | 3/1997 |
| JP | H11-314813 | A | 11/1999 |
| JP | 2003-012167 | A | 1/2003 |
| JP | 2003-029480 | A | 1/2003 |
| JP | 2014-208553 | A | 11/2014 |
| JP | 6775661 | B1 | 10/2020 |

* cited by examiner

IMAGE FORMING APPARATUS

CROSS-REFERENCE TO RELATED APPLICATION

This application is based upon and claims the benefit of priority from prior Japanese patent applications No. 2020-219779 filed on Dec. 29, 2020 and No. 2021-091563 filed on May 31, 2021, the entire contents of which are incorporated herein by reference.

TECHNICAL FIELD

The present disclosure relates to an image forming apparatus including a feeding tray capable of accommodating both a roll body having a configuration where a sheet-shaped medium is rolled in a roll shape and a plurality of sheet-shaped media stacked.

BACKGROUND

An image forming apparatus capable of accommodating both a roll body where a sheet-shaped paper is rolled in a roll shape and a cut sheet is known. For example, JP-A-H02-264556 discloses a facsimile (image forming apparatus) having a sheet feeding cassette (feeding tray) where a placement part for a roll body and a placement part for a cut sheet are formed. A sheet accommodated in the feeding tray is fed by a roller (feed roller).

In the image forming apparatus disclosed in JP-A-H02-264556, a feeding operation may be started even though a sheet to be used for printing is not accommodated in the feeding tray.

SUMMARY

An object of the present disclosure is to provide an image forming apparatus including a feeding tray in which both a roll body having a configuration where a sheet-shaped medium is rolled in a roll shape and a plurality of sheet-shaped media stacked are accommodated, and enables to determine whether a sheet-shaped medium is appropriately arranged in a predetermined position in the feeding tray.

An aspect of the present disclosure is an image forming apparatus including:

- a housing;
- a feeding tray capable of being inserted into and pulled out from the housing, and including a first accommodation part in which a roll body having a configuration where a sheet-shaped medium is rolled in a roll shape is accommodated and a second accommodation part in which a plurality of sheet-shaped media are accommodated in a state of being stacked;
- a feed roller configured to feed a sheet-shaped medium from the feeding tray toward a conveying path;
- an image forming unit configured to form an image on a sheet-shaped medium provided in the conveying path; and
- one or more detection units configured to detect whether a sheet-shaped medium is arranged in a predetermined position in the feeding tray.

According to the image forming apparatus of the present disclosure, it is detected whether the sheet-shaped medium is arranged in the predetermined position in the feeding tray. Therefore, in the image forming apparatus including the feeding tray in which both the roll body having the configuration where the sheet-shaped medium is rolled in the roll shape and the plurality of sheet-shaped media stacked are accommodated, it is possible to determine whether a sheet-shaped medium is appropriately arranged in the predetermined position in the feeding tray.

DETAILED DESCRIPTION

First Embodiment

Hereinafter, a printer 100 (an example of the image forming apparatus of the present disclosure) according to a first embodiment of the present disclosure will be described with reference to FIGS. 1 to 5B. Note that, the upper and lower direction, the right and left direction and the front and rear direction shown in FIG. 1 are referred to as the upper and lower direction, the right and left direction and the front and rear direction of the printer 100.

Overall Configuration of Printer 100

Figure 1:
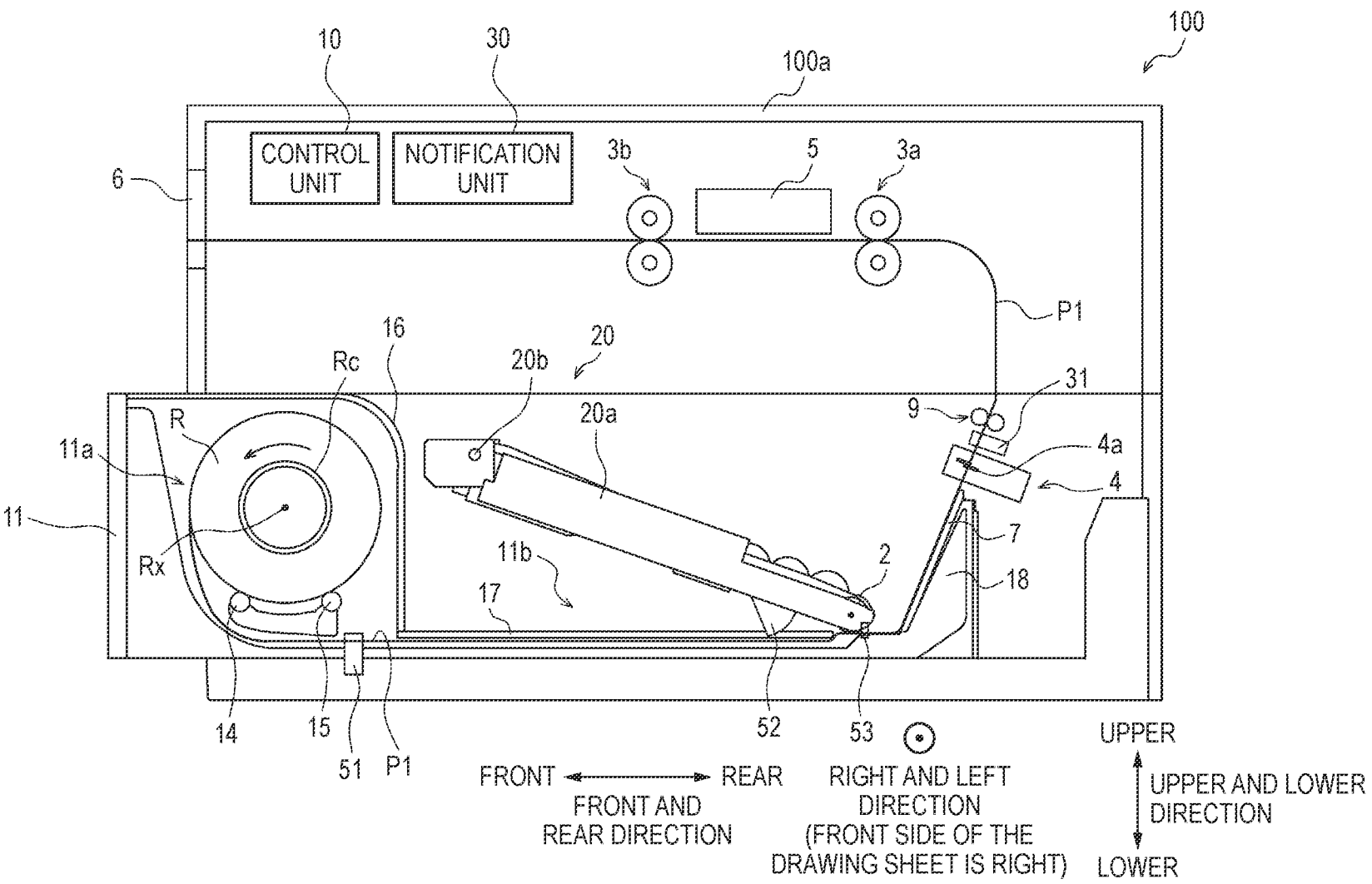
FIG. 1 is a schematic configuration view of a printer according to a first embodiment of the present disclosure.

As shown in FIG. 1, the printer 100 includes a housing 100*a*, a feeding tray 11, a feed roller 2, a conveying roller pair 3*a* (an example of the conveying roller of the present disclosure), a sheet discharging roller pair 3*b*, a cutter mechanism 4, a head 5 (an example of the image forming unit of the present disclosure), a sheet discharging tray 6, a guide 7, an intermediate roller pair 9 (an example of the intermediate roller of the present disclosure), a control unit 10, and a notification unit 30. The feeding tray 11 can be inserted into and pulled out from a lower part of the housing 100*a*. The insertion/pullout of the feeding tray 11 with respect to the housing 100*a* are detected by a sensor (not shown). The sheet discharging tray 6 configures a front sidewall of an upper part of the housing 100*a* and can be opened and closed with respect to the housing 100*a*.

The feeding tray 11 can be inserted into and pulled out from the housing 100*a*. The feeding tray 11 has a first accommodation part 11*a* capable of accommodating a roll body R where a long-length sheet P1 (hereinafter, referred to as roll sheet P1) is rolled in a roll shape and a second accommodation part 11*b* capable of accommodating a cut sheet P2 in a state of being multiply stacked (refer to FIG. 2), which is a sheet shorter than the roll sheet P1. Note that, in the present embodiment, the roll sheet P1 and the cut sheet P2 correspond to an example of the sheet-shaped medium of the present disclosure. In addition, a rear end wall part 18 extending upward is formed at a rear end portion of the feeding tray 11. The rear end wall part 18 is a member for preventing the cut sheet P2 accommodated in the second accommodation part 11*b* from falling off at the time when the feeding tray 11 is inserted into or pulled out from the housing 100*a*.

The first accommodation part 11*a* has a cylindrical core member Rc, two rollers 14 and 15, and a roll cover 16. The roll body R is one where the long-length sheet P1 is roiled in a roll shape on an outer peripheral surface of the cylindrical core member Rc. The roll body R is arranged so that an axis direction (a direction perpendicular to the drawing sheet of FIG. 1) along a rotation axis Rx (central axis of the core member Rc) is parallel to the right and left direction. The axial direction of the rotation axis Rx also corresponds to width directions of the roll sheet P1 and the cut sheet P2.

The two rollers 14 and 15 extend lengthwise along the right and left direction and are formed slightly longer than a width of the roll body R. The roller 15 is arranged behind the roller 14. The rollers 14 and 15 are arranged so that rotation axes thereof are parallel to the rotation axis Rx. The two rollers 14 and 15 are configured to support the roll body R from below in a state of being in contact with an outer peripheral surface of a lower part of the roll body R.

When the roll sheet P1 is unrolled from the roll body R, the two rollers 14 and 15 rotate according to the roll body R rotating in a counterclockwise direction (a solid line arrow in FIG. 1). The roll sheet P1 unrolled from the roll body R accommodated in the first accommodation part 11*a* passes through a path under a bottom surface 17 (which will be described later) of the second accommodation part 11*b* and is sent to a position directly under the feed roller 2 or a position on a further downstream side than the position directly under the feed roller 2 in a conveying direction. The roll sheet P1 is fed toward a conveying path by the feed roller 2, and is sent to the sheet discharging tray 6 via the intermediate roller pair 9, the conveying roller pair 3*a*, the head 5, and the sheet discharging roller pair 3*b*. Note that, the conveying path for the roll sheet P1 is defined by the feed roller 2, the intermediate roller pair 9, the conveying roller pair 3*a*, and the sheet discharging roller pair 3*b*.

The roll cover 16 is a member configured to cover the roll body R accommodated in the first accommodation part 11*a*. The roll cover 16 extends along the right and left direction and is formed longer than widths of the rollers 14 and 15. The roll cover 16 is also arranged to be able to be close to the outer peripheral surface of the roll body R of a maximum size that can be accommodated in the first accommodation part 11*a*. As a result, even if the roll body R is loosened and therefore the outer diameter of the roll body R is to increase, the outer peripheral surface of the roll body R comes into contact with an inner surface of roll cover 16, so that it is possible to restrict an increase in outer diameter of the roll body R.

The second accommodation part 11*b* is located behind the first accommodation part 11*a*, and has a bottom surface 17 configured to support the cut sheet P2 from below. The bottom surface 17 extends lengthwise along the right and left direction, and is formed slightly longer than the width of the cut sheet P2. The cut sheet P2 accommodated in the second accommodation part 11*b* is fed toward the conveying path by the feed roller 2, and is sent to the sheet discharging tray 6 via the intermediate roller pair 9, the conveying roller pair 3*a*, the head 5, and the sheet discharging roller pair 3*b*. The conveying path for the cut sheet P2 is defined by the feed roller 2, the intermediate roller pair 9, the conveying roller pair 3*a*, and the sheet discharging roller pair 3*b*.

In addition, a rear end part of the bottom surface 17 of the second accommodation part 11*b*, which is a central part in the right and left direction, has a notched portion. When printing the roll sheet P1, as described above, the roll sheet P1 unrolled from the roll body R passes through the path under the bottom surface 17 of the second accommodation part 11*b* and is sent to the feed roller 2. The roll sheet P1 comes then into contact with the feed roller 2 from the notched portion of the bottom surface 17 of the second accommodation part 11*b* in a state where the cut sheet P2 is not accommodated, and is thus fed toward the conveying path.

Note that, the printer 100 of the present embodiment has a configuration where the roll sheet P1 cannot be fed by the feed roller 2 in a case where the cut sheet P2 is accommodated in the second accommodation part 11*b*, when printing the roll sheet P1. This is because the printer 100 of the present embodiment has a configuration where the roll sheet P1 and the cut sheet P2 are fed by one common feed roller 2 and the cut sheet P2 is stacked on the roll sheet P1 unrolled from the roll body R. Therefore, in the present embodiment, when printing the roll sheet P1, the cut sheet P2 should be removed from the second accommodation part 11*b*. In addition, when printing the cut sheet P2, if the roll sheet P1 is arranged on a further downstream side than a feed position where the feed roller 2 can feed the roll sheet P1 and the cut sheet P2, in the conveying direction of the roll sheet P1 and the cut sheet P2, the roll sheet P1 may interfere with feeding of the cut sheet P2. Therefore, when printing the cut sheet P2, preferably, the roll body R is not accommodated in the first accommodation part 11*a*, the roll sheet P1 is not unrolled from the roll body R accommodated in the first accommodation part 11*a*, or even though the roll sheet P1 is unrolled from the roll body R accommodated in the first accommodation part 11*a*, the roll sheet P1 is arranged on a further upstream side than the feed position in the conveying direction. In addition, in the present embodiment, when inserting the feeding tray 11 into the housing 100*a*, at least a part of the first accommodation part 11*a* and the entire second accommodation part 11*b* are in a state of being placed inside the housing 100*a*.

The feed roller 2 is arranged behind the first accommodation part 11*a* and near the rear end portion of the second accommodation part 11*b*. The feed roller 2 is configured to rotate by drive of a feeding motor to feed the roll sheet P1 and the cut sheet P2 from the feeding tray 11 to the conveying path. As described above, the conveying path for the roll sheet P1 and the conveying path for the cut sheet P2 are all defined by the feed roller 2, the intermediate roller pair 9, the conveying roller pair 3*a*, and the sheet discharging roller pair 3*b*. Therefore, the feed roller 2 is configured to feed the roll sheet P1 and the cut sheet P2 along the common conveying path.

Figure 2:
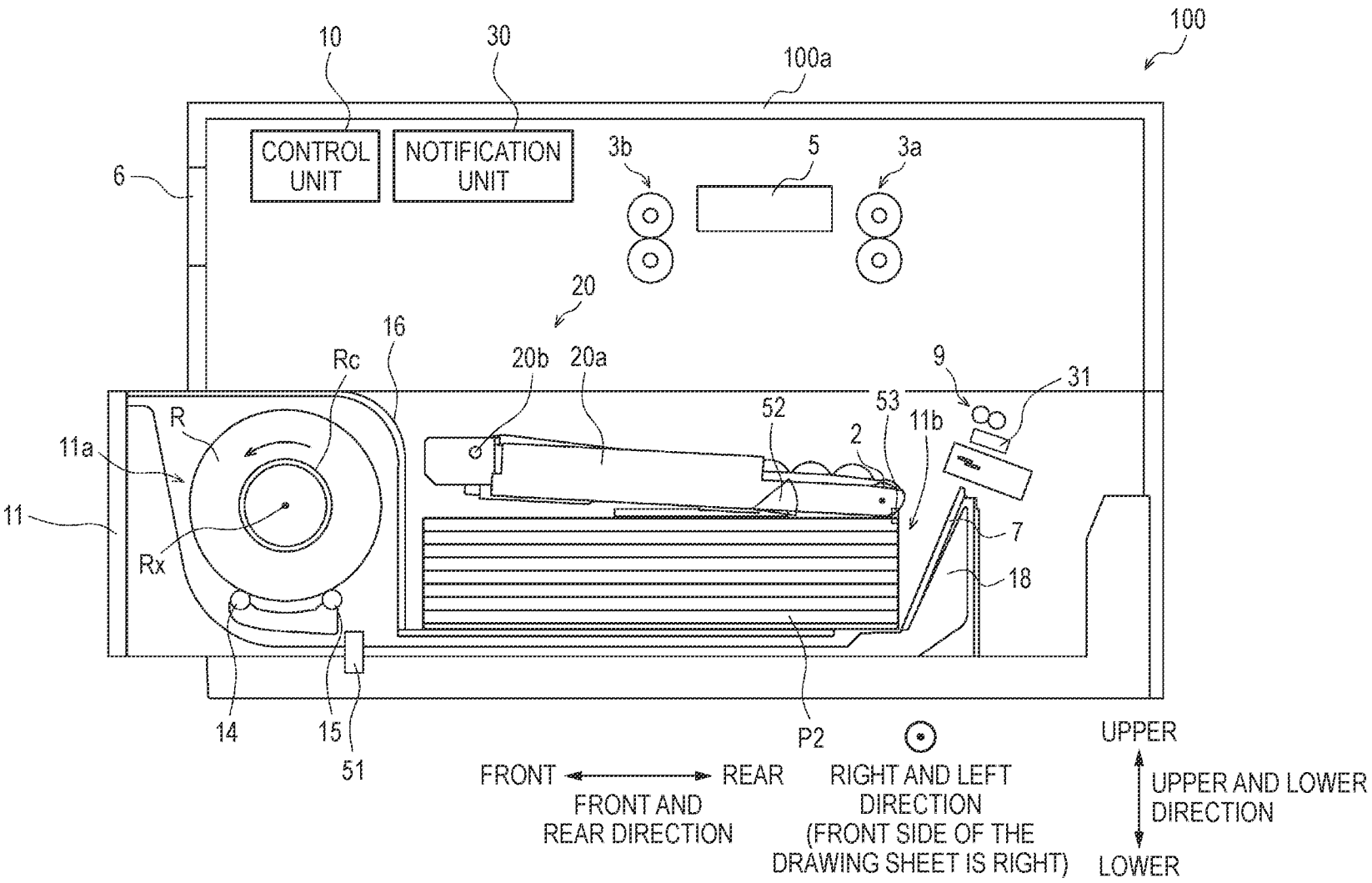
FIG. 2 is a schematic configuration view of the printer at the time of accommodating a cut sheet.

In addition, the printer 100 of the present embodiment has a swing arm 20*a* configured to rotatably support the feed roller 2 and a swing shaft 20*b* configured to rotatably support the swing arm 20*a* on the housing 100*a*. A direction of a rotation axis of the swing shaft 20*b* is parallel to the right and left direction. The swing shaft 20*b* may be configured to support the swing arm 20*a* on the housing 100*a* directly or indirectly. When conveying the roll sheet P1, as shown in FIG. 1, the swing arm 20*a* swings about the swing shaft 20*b*, so that the feed roller 2 comes into contact with the roll sheet P1 unrolled from the roll body R accommodated in the first accommodation part 11*a*. When conveying the cut sheet P2, as shown in FIG. 2, the swing arm 20*a* swings about the swing shaft 20*b*, so that the feed roller 2 comes into contact with the cut sheet P2 accommodated in a state of being multiply stacked in the second accommodation part 11*b*. Thereby, the feed roller 2 can feed the roll sheet P1 and the cut sheet P2 to the conveying path.

The cutter mechanism 4 is arranged in a position on a further downstream side than the feed roller 2 in a conveying direction (hereinafter, simply referred to as "conveying direction") along the conveying path of the roll sheet P1 and the cut sheet P2 and on a further upstream side than the head 5 (which will be described later) in the conveying direction. The cutter mechanism 4 includes, for example, cutters 4*a*, which are two rotating blades, and a cutting motor (not shown) configured to reciprocally drive the cutters 4*a* in the axial direction. The roll sheet P1 unrolled from the roll body R and conveyed along the conveying path is cut in the width direction of the roll sheet P1 by the cutters 4*a* as the cutting motor is driven under control of the control unit 10. This forms a rear end on the roll sheet P1 that is sent to the sheet discharging tray 6.

The guide 7 is provided behind the feed roller 2 and on a further upstream side than the cutter mechanism 4 in the conveying direction. The guide 7 is to guide the roll sheet P1 and the cut sheet P2 fed by the feed roller 2 toward the cutter mechanism 4. As shown in FIG. 1, the guide 7 is tilted so that it is located upward from the front toward the rear in the front and rear direction. The guide 7 extends lengthwise along the right and left direction, and is formed slightly longer than the widths of the roll sheet P1 and the cut sheet P2. A surface of the guide 7 is formed with a fine unevenness pattern repeating along the conveying direction. Here, the short-length sheet such as the cut sheet P2 is separated, so that double feeding can be prevented.

The intermediate roller pair 9 is provided on a further downstream side than the cutter mechanism 4 in the conveying direction and on a further upstream side than the head 5 in the conveying direction. The intermediate roller pair 9 is configured to convey the roll sheet P1 and the cut P2 to the conveying roller pair 3*a*. The intermediate roller pair 9 is configured by a drive roller configured to rotate by drive of an intermediate motor (not shown) and a driven roller configured to rotate according to the drive roller. In addition, an intermediate register sensor 31 (an example of the conveying detection unit of the present disclosure) is arranged near the intermediate roller pair 9, on a further upstream side than the intermediate roller pair 9 in the conveying direction, and on a downstream side than the cutter mechanism 4 in the conveying direction. The intermediate register sensor 31 is a sensor that can detect the roll sheet P1 or the cut sheet P2 in the conveying path. More specifically, the intermediate register sensor 31 is a sensor configured to detect whether the roll sheet P1 or the cut sheet P2, which is conveyed along the conveying path, has reached the intermediate roller pair 9.

The conveying roller pair 3*a* is configured by a drive roller configured to rotate by drive of a conveying motor (not shown) and a driven roller configured to rotate according to the drive roller. The sheet discharging roller pair 3*b* is configured by a drive roller configured to rotate by drive of a sheet discharging motor (not shown) and a driven roller configured to rotate according to the drive roller. The conveying motor and the sheet discharging motor (not shown) are driven under control of the control unit 10, and therefore, the conveying roller pair 3*a* and the sheet discharging roller pair 3*b* rotate while sandwiching the roll sheet P1 (or cut sheet P2), so that the roll sheet P1 (or cut sheet P2) is conveyed.

The head 5 is to form an image on the roll sheet P1 and the cut sheet P2, and is arranged on a further downstream side than the conveying roller pair 3*a* in the conveying direction and on a further upstream side than the sheet discharging roller pair 3*b* in the conveying direction. The head 5 includes a plurality of nozzles (nozzle) formed on a lower surface and a driver IC. When the driver IC is driven by control of the control unit 10, ink is ejected from the nozzles. When the roll sheet P1 (or cut sheet P2) conveyed by the conveying roller pair 3*a* passes through a position facing the lower surface of the head 5, the ink is ejected from the nozzles of the head 5, thereby forming an image on the roll sheet P1 and the cut sheet P2. Note that, the head 5 may be either a line-type configured to eject the ink from the nozzles in a state where a position is fixed or a serial-type configured to eject the ink from the nozzles while moving in the axis direction of the rotation axis Rx. The roll sheet P1 (or cut sheet P2) on which the image is formed by the head 5 is accommodated on the sheet discharging tray 6 in a state of opening with respect to the housing 100*a*.

In the present embodiment, the horizontal components in the conveying direction of the roll sheet P1 and the cut sheet P2 that are fed by the feed roller 2 are a direction from the rear toward the front in the front and rear direction, and the horizontal components in the conveying direction of the roll sheet P1 and the cut sheet P2 that pass through the position facing the lower surface of the head 5 and are discharged from the sheet discharging tray 6 in an open state to an outside are a direction from the rear toward the front in the front and rear direction. That is, the printer 100 of the present embodiment has a so-called U-turn path configuration where the conveying direction is folded back on the way.

The control unit 10 is connected to the feeding motor, the intermediate motor, the conveying motor, the sheet discharging motor, the driver IC, the cutting motor, and the like via an internal bus (not shown). The control unit 10 is also electrically connected to the intermediate resister sensor 31, and sensors 51*b*, 52*b* and 53*b*, which will be described later. The control unit 10 has a CPU (Central Processing Unit), a ROM (Read Only Memory) and a RAM (Random Access Memory). In the ROM, programs and data for the CPU to perform various controls are stored. The RAM is configured to temporarily store data that is used at the time when the CPU runs programs.

The notification unit 30 can execute a notification operation of issuing a notification to a user. The notification unit 30 is, for example, a display provided to the printer 100, and is configured to display information that is to be notified to the user, thereby executing the notification operation to the user. Alternatively, the notification unit 30 is a speaker provided to the printer 100, and may be configured to execute the notification operation to the user by uttering information, which is to be notified to the user, by voice, or may be configured to execute the notification operation by other methods. The notification operation that is executed by the notification unit 30 will be described in detail in a section pertaining to processing of the control unit 10, which will be described later.

Roll Sheet Detection Unit 51

Figure 3A:
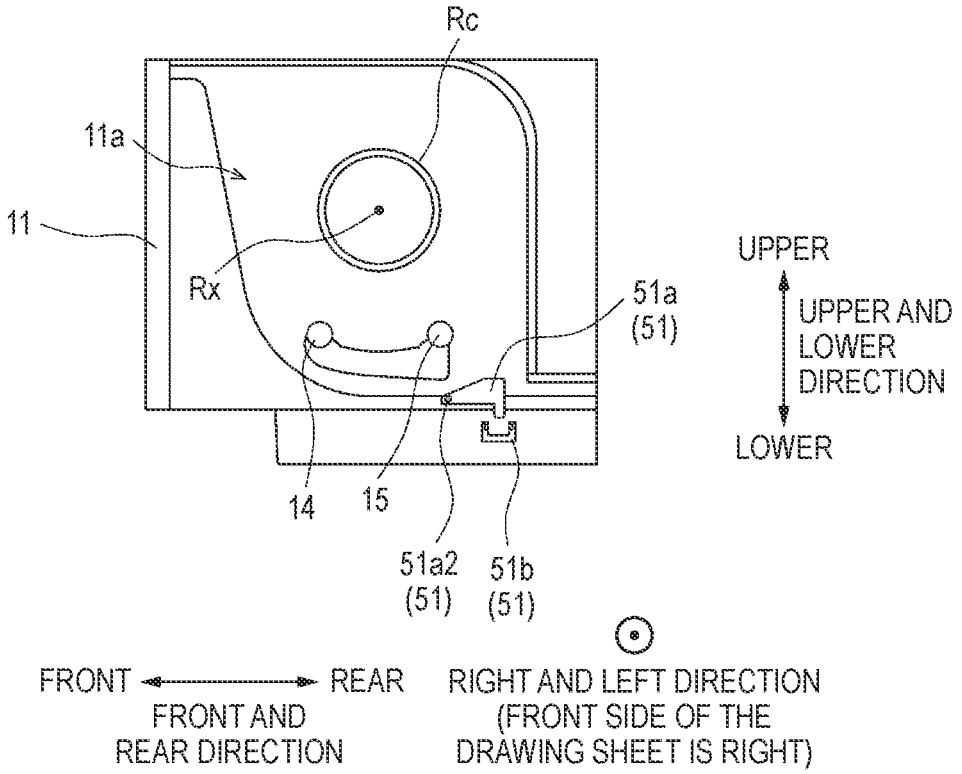
FIG. 3A shows a roll sheet detection unit at the time when a roll body is not accommodated.
Figure 3B:
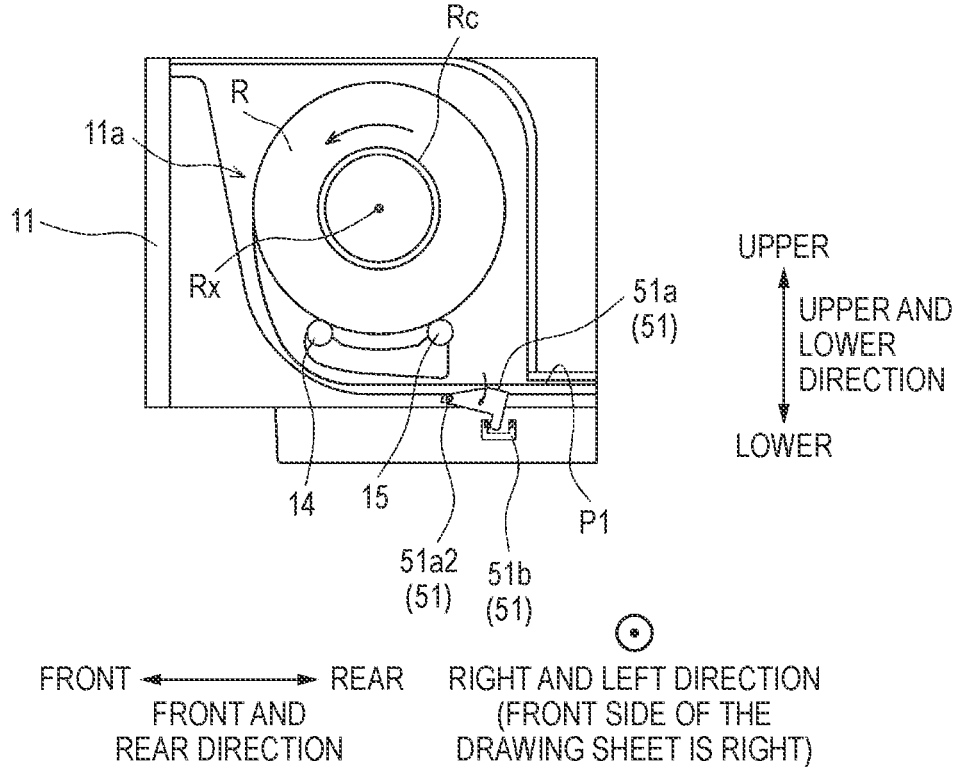
FIG. 3B shows the roll sheet detection unit at the time when a roll body is accommodated.

The printer 100 of the first embodiment also includes a roll sheet detection unit 51 (an example of the first detection unit of the present disclosure) configured to detect whether the roll sheet P1 is accommodated in the first accommodation part 11*a*. The roll sheet detection unit 51 is a sensor that can detect the roll sheet P1 unrolled from the roll body R. The roll sheet detection unit 51 is provided below and behind the roller 15 of the first accommodation part 11*a*. The roll sheet detection unit 51 includes an actuator 51*a* and a sensor 51*b*, as shown in FIGS. 3A and 3B. The actuator 51*a* is supported to be rotatable about a rotary shaft 51*a*2. An axis direction of the rotary shaft 51*a*2 is parallel to the right and left direction. The sensor 51*b* is a sensor configured to detect the actuator 51*a*. The sensor 51*b* is, for example, a photo sensor having a light emitting element and a light receiving element (not shown). In a case where the roll sheet P1 unrolled from the roll body R is not accommodated in the first accommodation part 11*a*, the actuator 51*a* does not block a light path and is not detected by the sensor 51*b*, as shown in FIG. 3A. In a case where the roll sheet P1 unrolled from the roll body R is accommodated in the first accommodation part 11*a*, the roll sheet P1 unrolled from the roll body R comes into contact with the actuator 51*a*, as shown in FIG. 3B. The actuator 51*a* is then pushed and rotated about the rotary shaft 51*a*2 by the roll sheet P1 (the solid line arrow in FIG. 3B) to shield the light path, so that it is detected by the sensor 51*b*. This allows the roll sheet detection unit 51 to detect whether the roll sheet P1 unrolled from the roll body R is accommodated in the first accommodation part 11*a*. Note that, the actuator 51*a* and the sensor 51*b* may be supported on the housing 100*a* or on the feeding tray 11. In addition, any one of the actuator 51*a* and the sensor 51*b* may be supported on the housing 100*a* and the other may be supported on the feeding tray 11.

Cut Sheet Detection Unit 52

Figure 4A:
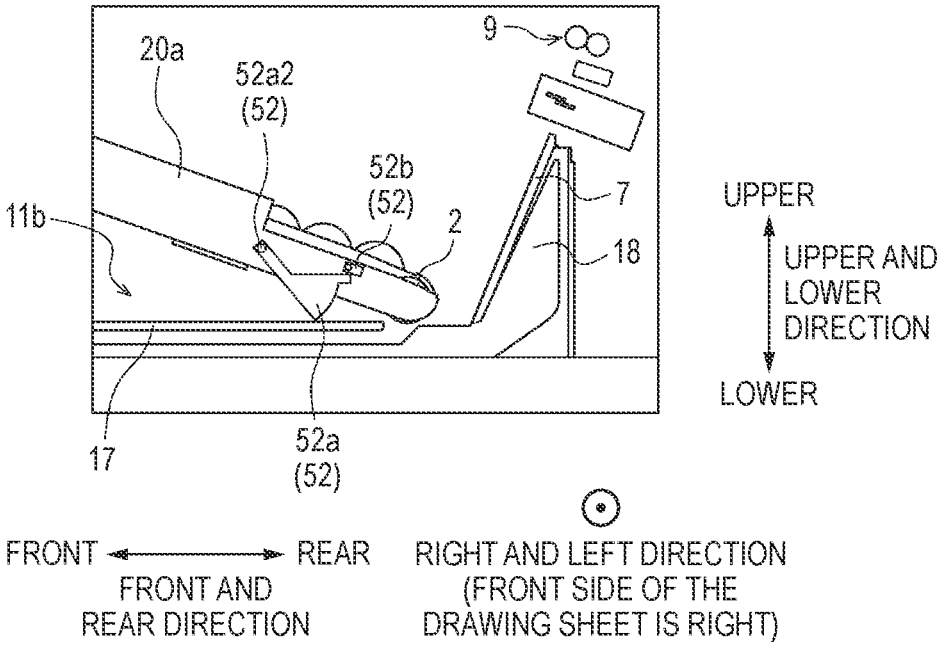
FIG. 4A shows a cut sheet detection unit at the time when a cut sheet is not accommodated.
Figure 4B:
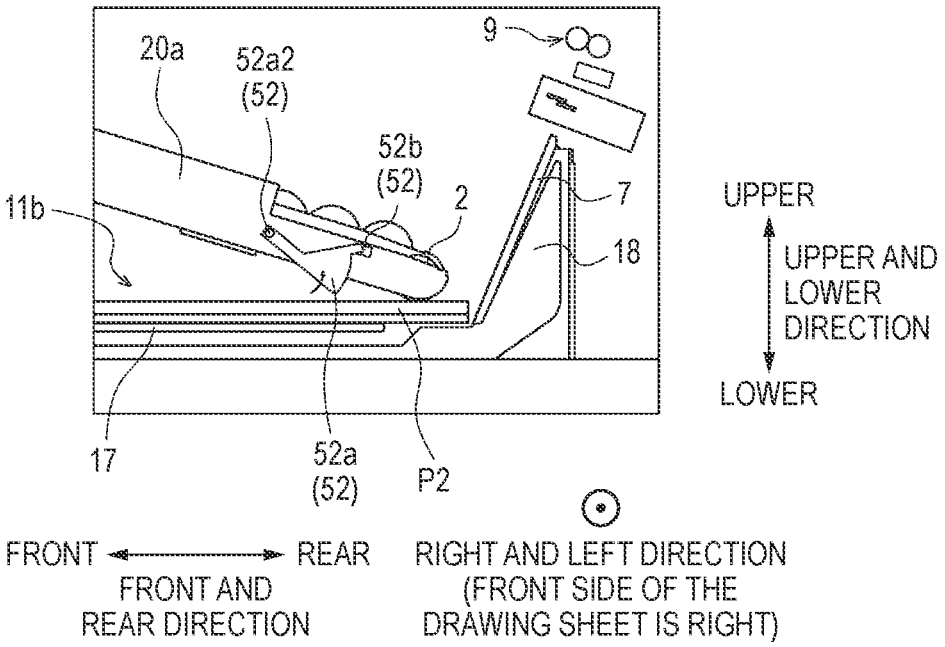
FIG. 4B shows the cut sheet detection unit at the time when a cut sheet is accommodated.

The printer 100 of the first embodiment also includes a cut sheet detection unit 52 (an example of the second detection unit of the present disclosure) configured to detect whether the cut sheet P2 is accommodated in the second accommodation part 11*b*. The cut sheet detection unit 52 is attached to the swing arm 20*a*. As shown in FIGS. 4A and 4B, the cut sheet detection unit 52 includes an actuator 52*a* and a sensor 52*b*. The actuator 52*a* is supported to be rotatable about a rotary shaft 52*a*2 by the swing arm 20*a*. An axis direction of the rotary shaft 52*a*2 is parallel to the right and left direction. The sensor 52*b* is a sensor configured to detect the actuator 52*a*. The sensor 52*b* is attached to the swing arm 20*a*. The sensor 52*b* is, for example, a photo sensor having a light emitting element and a light receiving element (not shown). In a case where the cut sheet P2 is not accommodated in the second accommodation part 11*b*, the actuator 52*a* does not block a light path and is not detected by the sensor 52*b*, as shown in FIG. 4A. In a case where the cut sheet P2 is accommodated in the second accommodation part 11*b*, the cut sheet P2 stacked on the bottom surface 17 comes into contact with the actuator 52*a*, as shown in FIG. 4B. The actuator 52*a* is then pushed and rotated about the rotary shaft 52*a*2 by the cut sheet P2 (the solid line arrow in FIG. 4B) to shield the light path, so that it is detected by the sensor 52*b*. This allows the cut sheet detection unit 52 to detect whether the cut sheet P2 is accommodated in the second accommodation part 11*b*. Note that, the actuator 52*a* and the sensor 52*b* may be directly supported on the housing 100*a* without passing through the swing arm 20*a* or may be supported on the feeding tray 11. In addition, any one of the actuator 52*a* and the sensor 52*b* may be supported on the housing 100*a* and the other may be supported on the feeding tray 11. In FIGS. 4A and 4B, a sheet presence/absence detection unit 53 is not shown.

Sheet Presence/Absence Detection Unit 53

Figure 5A:
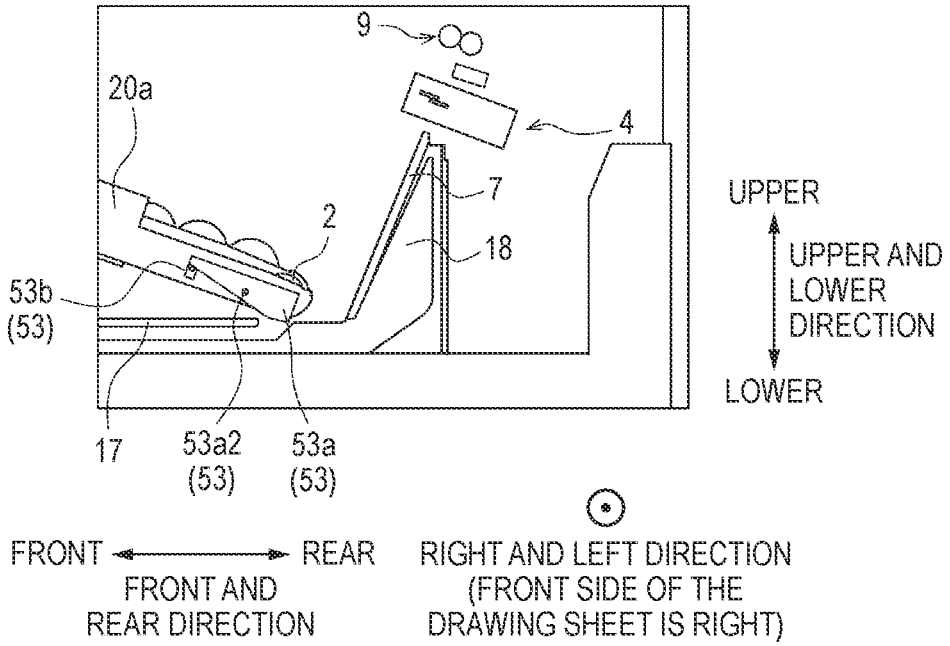
FIG. 5A shows a sheet presence/absence detection unit at the time when a sheet is not set.
Figure 5B:
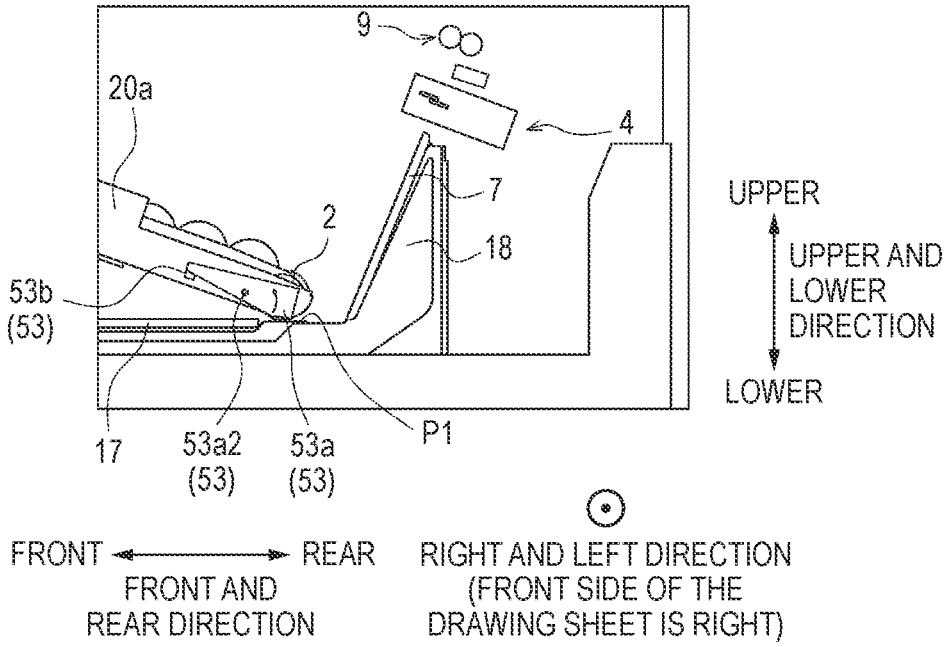
FIG. 5B shows the sheet presence/absence detection unit at the time when a sheet is appropriately set.
Figure 6A:
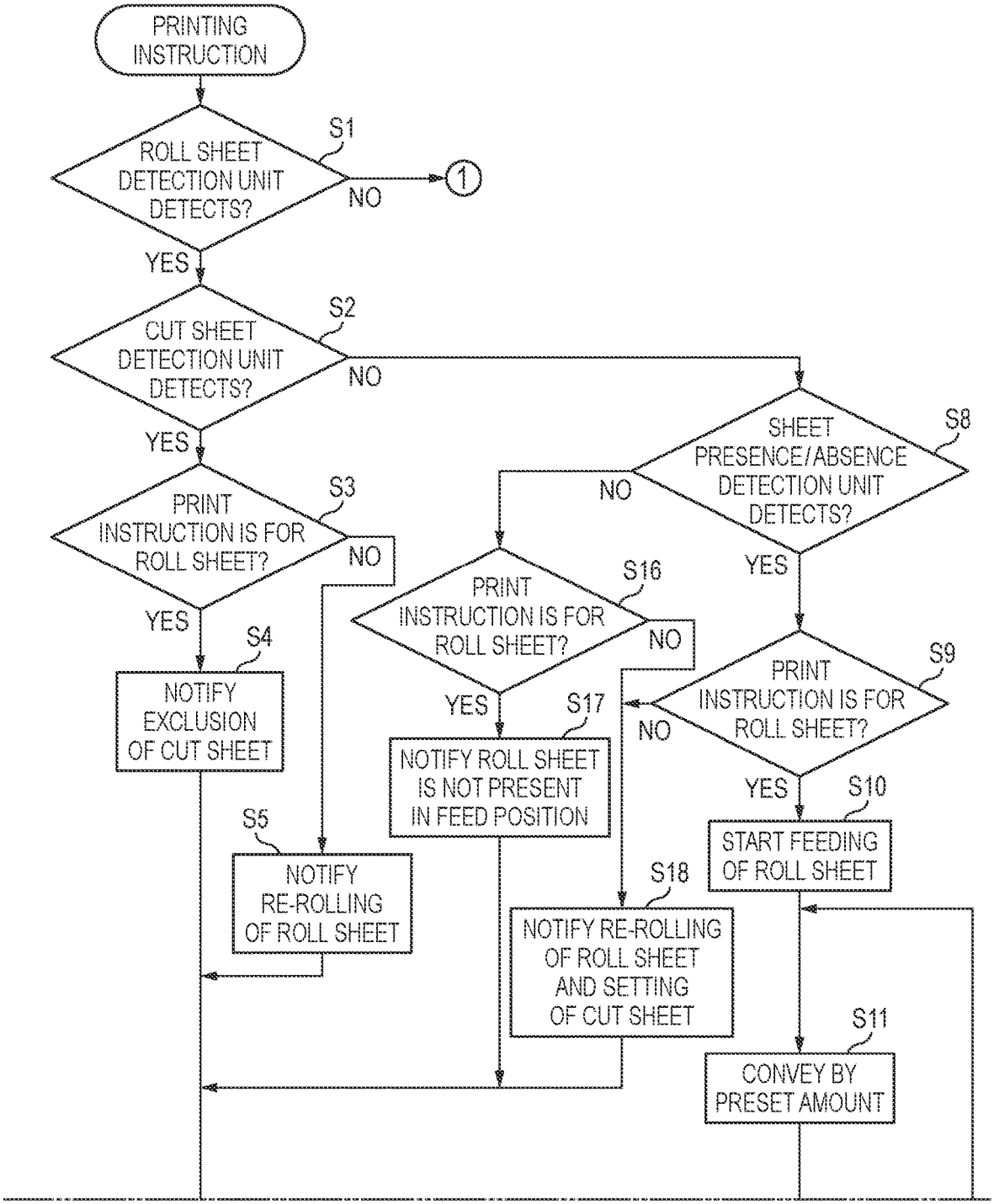
FIGS. 6A and 6B show a first half part of a flowchart showing an example of a processing procedure that is executed in the printer of the first embodiment.
Figure 6B:
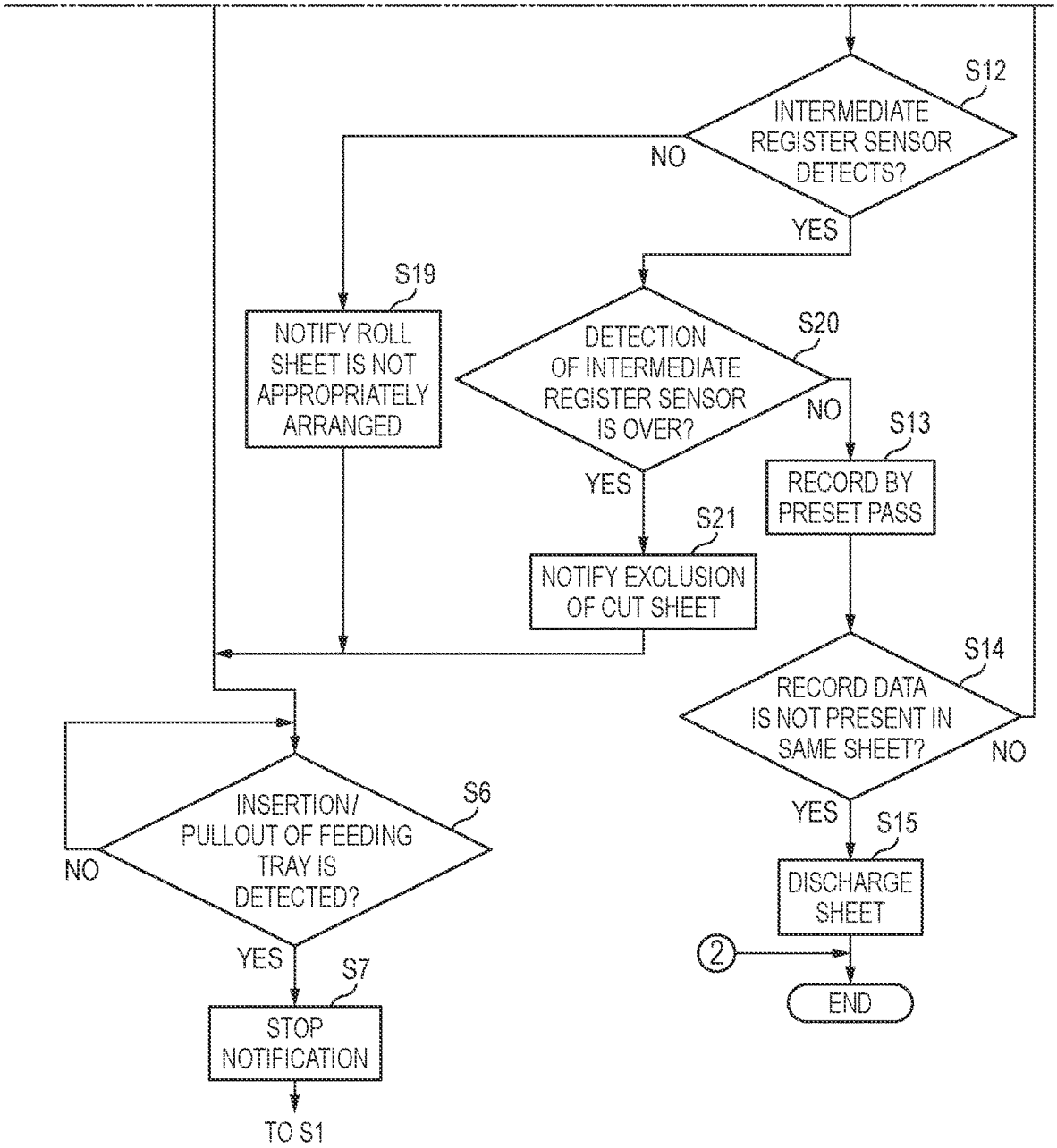
Figure 7A:
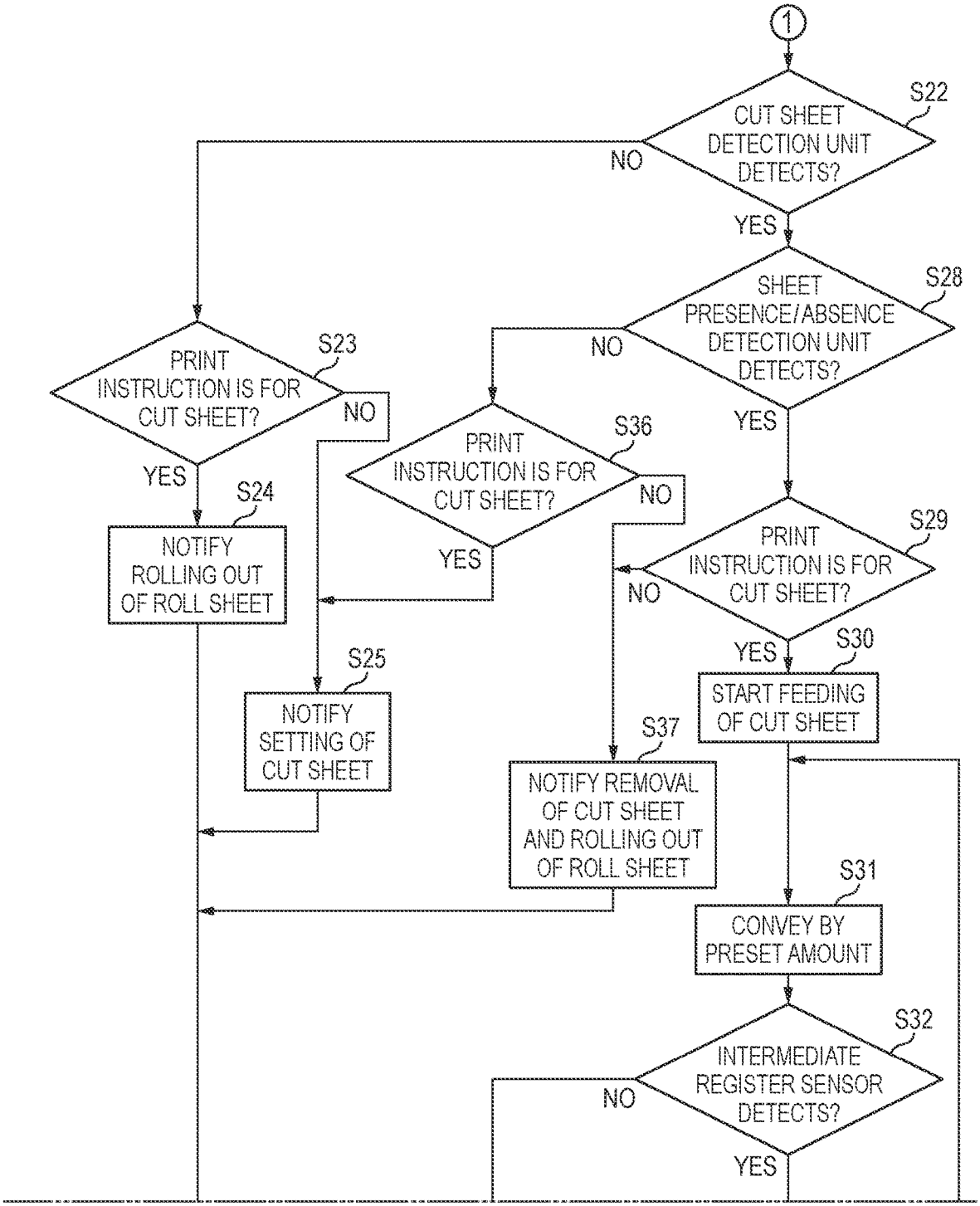
FIGS. 7A and 7B show a second half part of the flowchart showing the example of the processing procedure that is executed in the printer of the first embodiment.
Figure 7B:
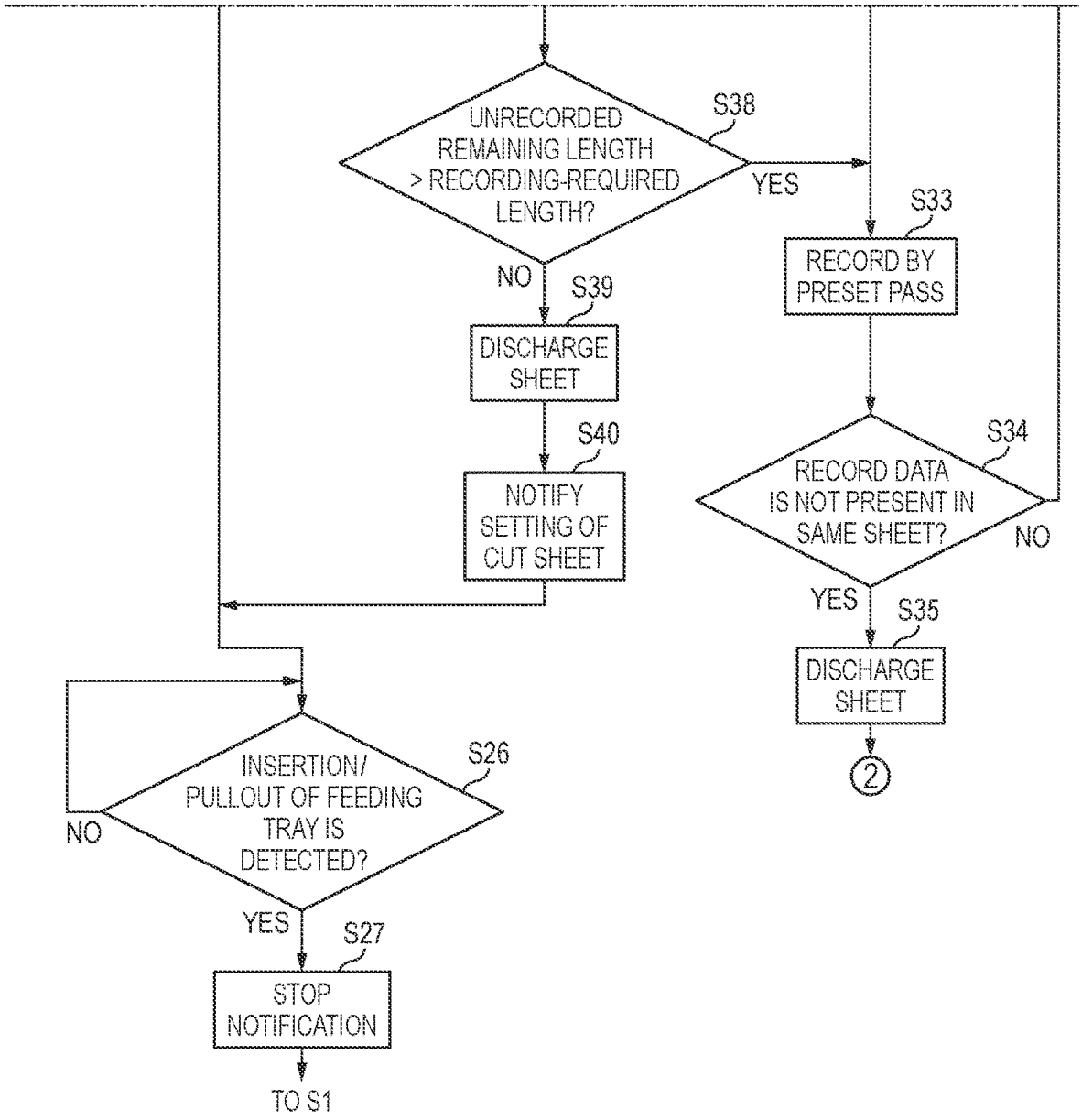
Figure 8A:
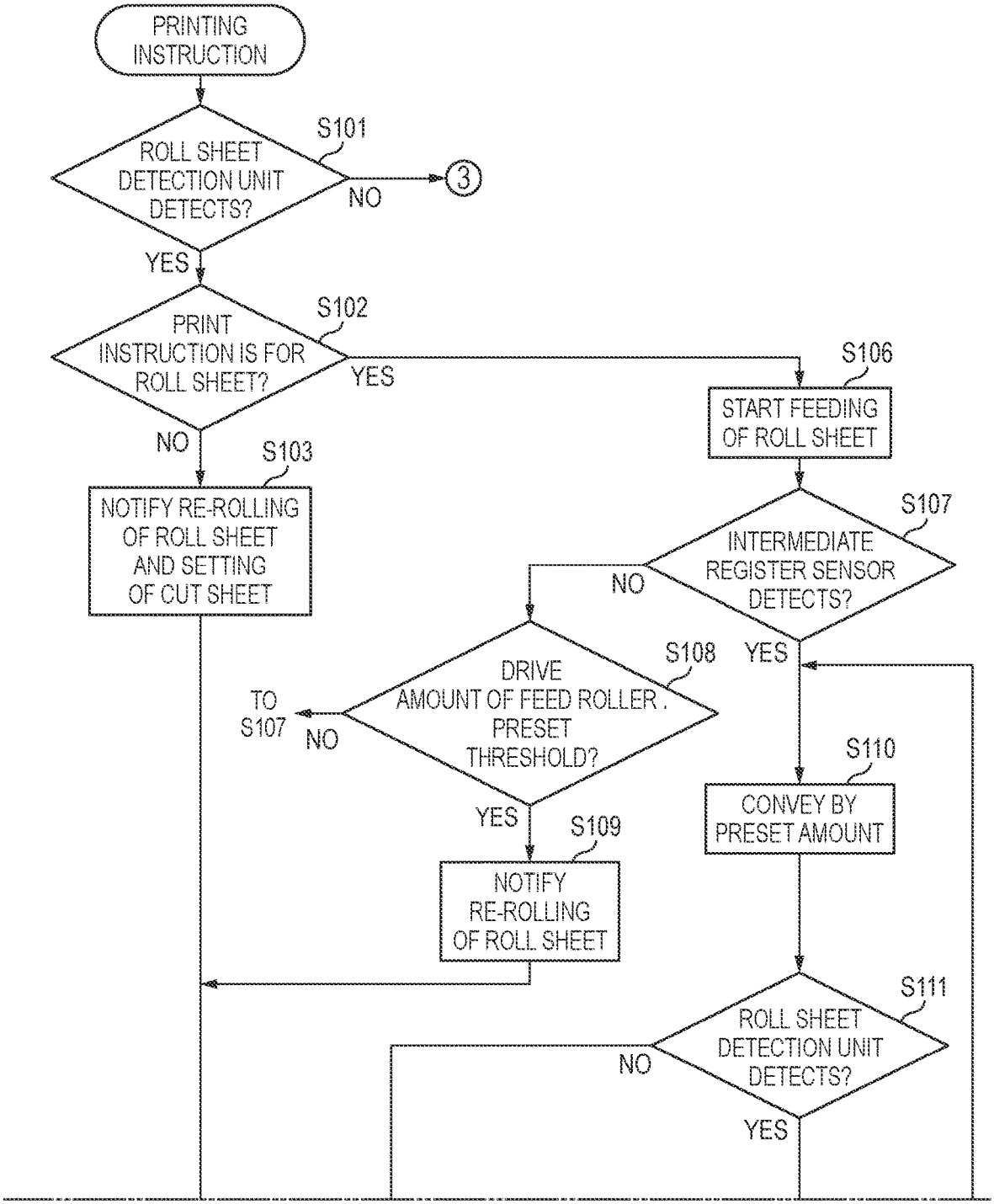
FIGS. 8A and 8B show a first half part of a flowchart showing an example of a processing procedure that is executed in a printer of a second embodiment.
Figure 8B:
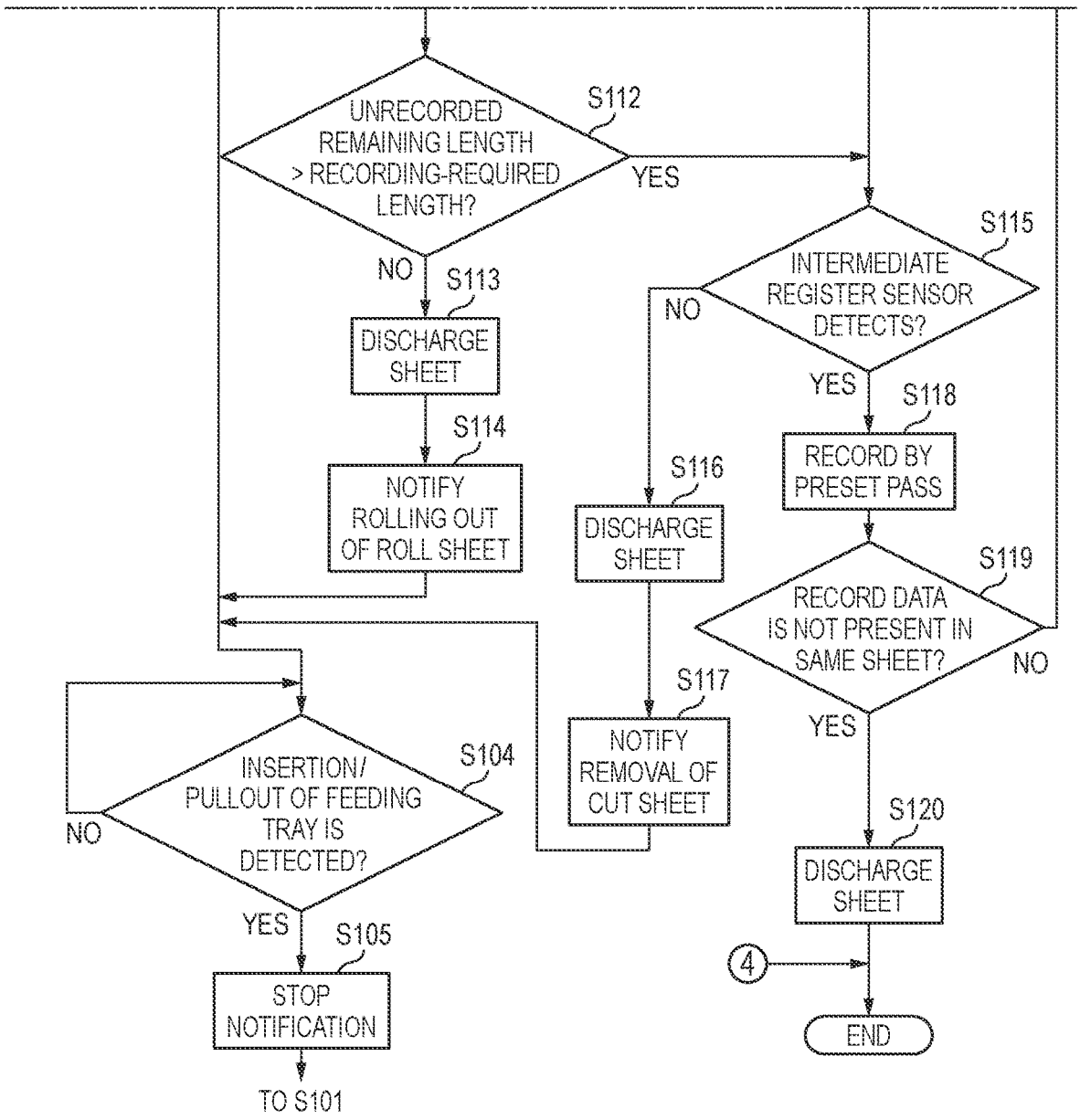
Figure 9A:
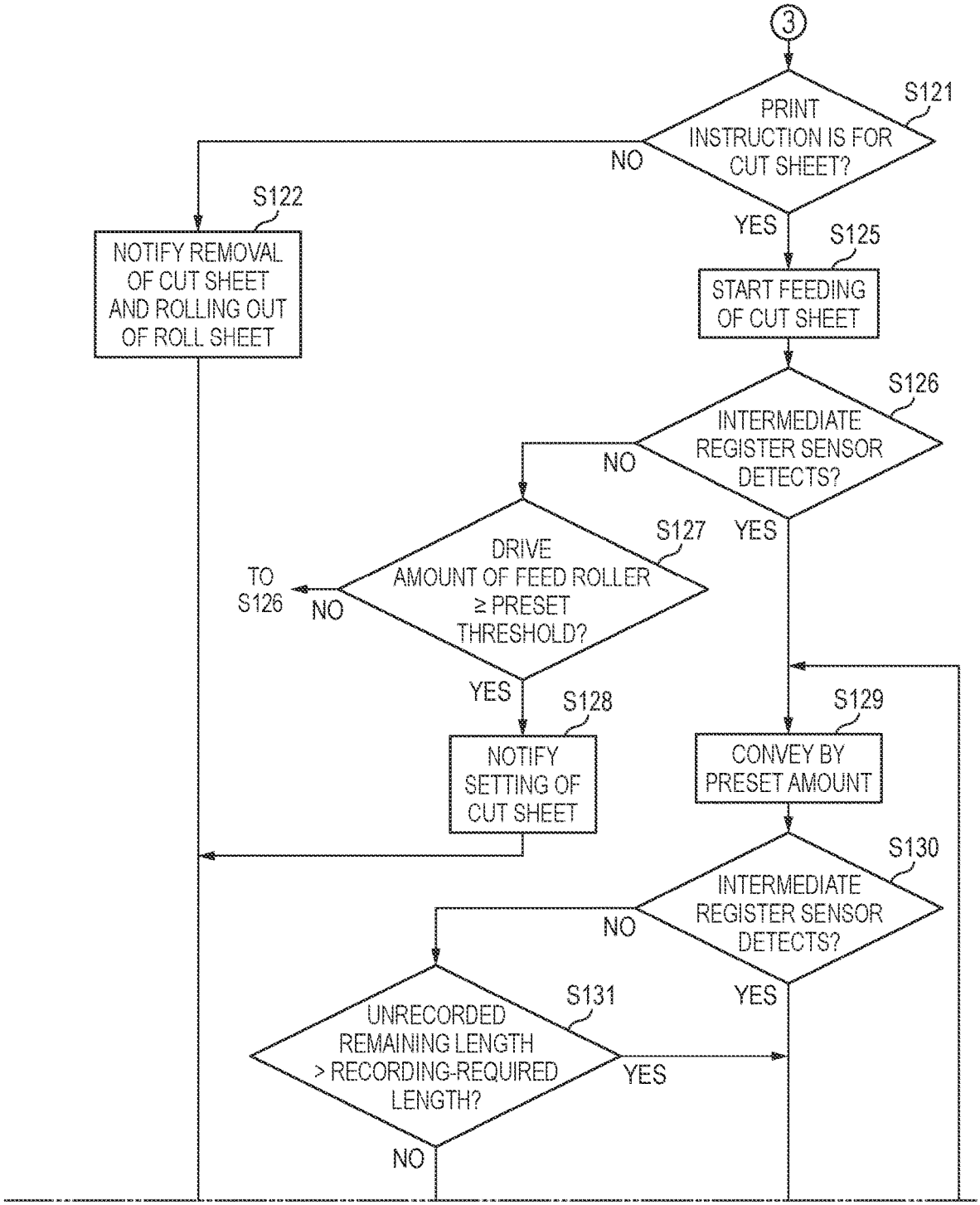
FIGS. 9A and 9B show a second half part of the flowchart showing the example of the processing procedure that is executed in the printer of the second embodiment.
Figure 9B:
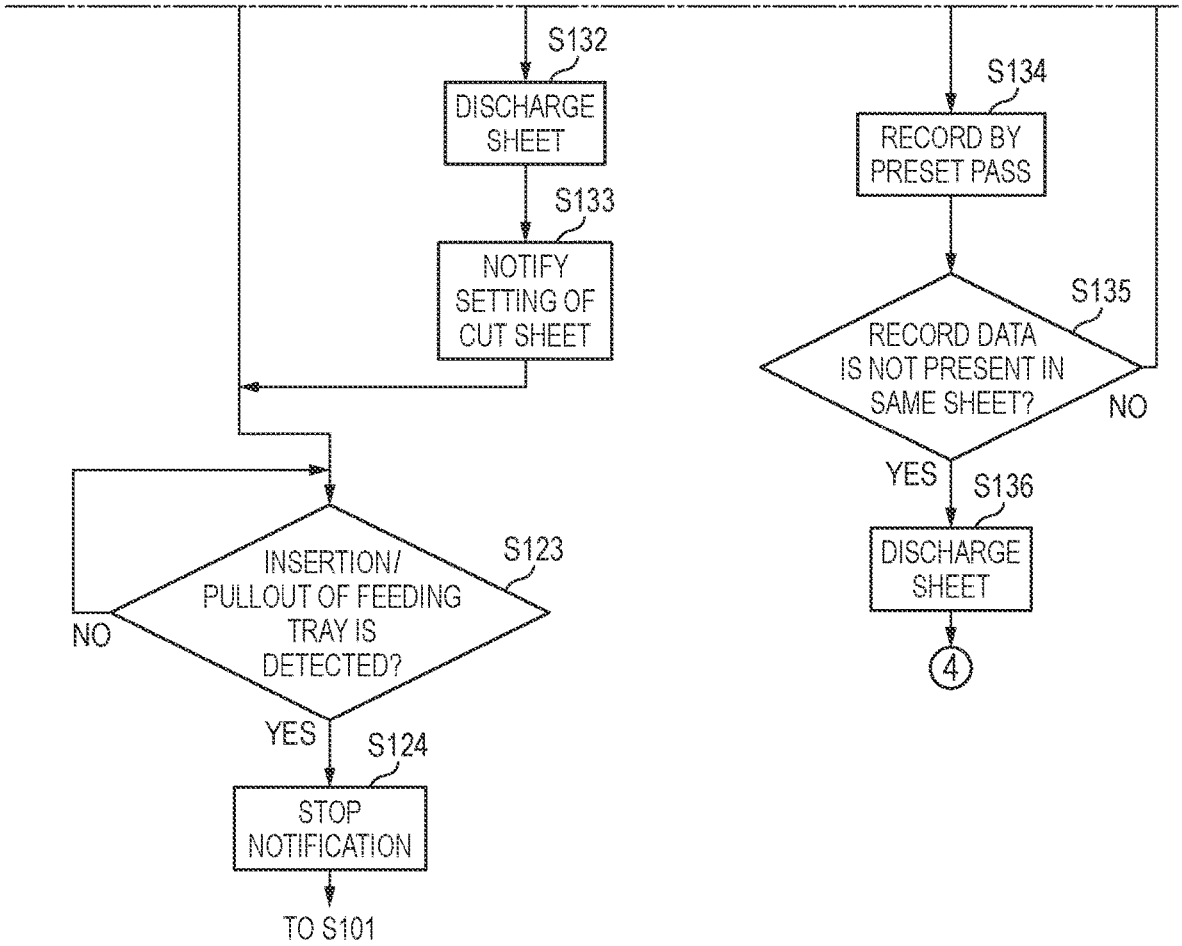

The printer of the first embodiment also includes a sheet presence/absence detection unit 53 (an example of the third detection unit of the present disclosure) configured to detect whether the roll sheet P1 or the cut sheet P2 is arranged in the feed position where the feed roller 2 can feed the roll sheet P1 and the cut sheet P2. More specifically, the sheet presence/absence detection unit 53 is a sensor configured to detect whether the roll sheet P1 or the cut sheet P2 is present in the feed position on a further downstream side than the roll sheet detection unit 51 or the cut sheet detection unit 52 in the conveying direction, and directly under the feed roller 2 or on a further downstream side than a position directly under the feed roller in the conveying direction. The "feed position" of the feed roller 2 is a position on a further downstream side than the roll sheet detection unit 51 or the cut sheet detection unit 52 in the conveying direction, and directly under the feed roller 2 or on a further downstream side than a position directly under the feed roller in the conveying direction, and is preferably a position on a further downstream side than the position directly under the feed roller 2 in the conveying direction. The sheet present detection unit 53 is attached to the swing arm 20*a*. A part of the sheet presence/absence detection unit 53 is arranged on a further downstream side than the position directly under the feed roller 2 in the conveying direction along the conveying path. The sheet presence/absence detection unit 53 includes an actuator 53*a* and a sensor 53*b*, as shown in FIGS. 5A and 5B. The actuator 53*a* is supported to be rotatable about a rotary shaft 52*a*2 by the swing arm 20*a*. An axis direction of the rotary shaft 53*a*2 is parallel to the right and left direction. The sensor 53*b* is a sensor configured to detect the actuator 53*a*. The sensor 53*b* is attached to the swing arm 20*a*. The sensor 53*b* is, for example, a photo sensor having a light emitting element and a light receiving element (not shown). In a case where the roll sheet P1 or the cut sheet P2 is not present in a position on a further downstream side than the position directly under the feed roller 2 in the conveying direction, the actuator 53*a* does not block a light path and is not detected by the sensor 53*b*, as shown in FIG. 5A. In a case where the roll sheet P1 or the cut sheet P2 is present in a position on a further downstream side than the position directly under the feed roller 2 in the conveying direction, the roll sheet P1 or the cut sheet P2 comes into contact with the actuator 53, as shown in FIG. 5B. FIG. 5B shows a case where the roll sheet P1 unrolled from the roll body R is present in a position on a further downstream side than the position directly under the feed roller 2 in the conveying direction. The actuator 53*a* is then pushed and rotated about the rotary shaft 53*a*2 by the roll sheet P1 or the cut sheet P2 (the solid line arrow in FIG. 5B) to shield the light path, so that it is detected by the sensor 53*b*. This allows the sheet presence/absence detection unit 53 to detect whether the roll sheet P1 or the cut sheet P2 is present in a position on a further downstream side than the position directly under the feed roller 2 in the conveying direction. Note that, the actuator 53*a* and the sensor 53*b* may be directly supported on the housing 100*a* without passing through the swing arm 20*a* or may be supported on the feeding tray 11. In addition, any one of the actuator 53*a* and the sensor 53*b* may be supported on the housing 100*a* and the other may be supported on the feeding tray 11. In FIGS. 5A and 5B, the cut sheet detection unit 52 is not shown.

A distance between the roll sheet detection unit 51 and the sheet presence/absence detection unit 53 along the conveying path is equal to or greater than a distance between the feed roller 2 and the intermediate roller pair 9 along the conveying path, and is equal to or greater than a distance between the intermediate roller pair 9 and the conveying roller pair 3*a* along the conveying path.

Processing of Control Unit 10

Subsequently, an example of processing that is performed by the control unit 10 when printing is performed on the roll sheet P1 or the cut sheet P2 in the printer 100 is described with reference to FIGS. 6A, 6B, 7A and 7B. The processing to be described below is started when the control unit 10 receives a printing instruction. The printing instruction is input by the user, for example, via a terminal such as a PC or a smart phone connected to the printer 100, or via an input device (not shown) included in the printer 100. In the present embodiment, the printing instruction is an instruction for printing on the roll sheet P1 accommodated in the first accommodation part or an instruction for printing on the cut sheet P2 accommodated in the second accommodation part.

First, the control unit 10 determines whether the roll sheet detection unit 51 has detected that the roll sheet P1 is accommodated in the first accommodation part 11*a* (step S1). When it is determined that the roll sheet detection unit 51 has not detected that the roll sheet P1 is accommodated in the first accommodation part 11*a* (S1: NO), the control unit 10 proceeds to step S22, which will be described later. When it is determined that the roll sheet detection unit 51 has detected that the roll sheet P1 is accommodated in the first accommodation part 11*a* (S1: YES), the control unit 10 determines whether the cut sheet detection unit 52 has detected that the cut sheet P2 is accommodated in the second accommodation part 11*b* (step S2).

When it is determined that the cut sheet detection unit 52 has not detected that the cut sheet P2 is accommodated in the second accommodation part 11*b* (S2: NO), the control unit 10 proceeds to step S8, which will be described later. When it is determined that the cut sheet detection unit 52 has detected that the cut sheet P2 is accommodated in the second accommodation part 11*b* (S2: YES), the control unit 10 determines that both the roll sheet P1 and the cut sheet P2 are accommodated in the feeding tray 11. The control unit 10 then determines whether the input printing instruction is for the roll sheet P1 (step S3).

When it is determined that the printing instruction is for the roll sheet P1 (step S3: YES), the control unit 10 causes the notification unit 30 to execute, as the notification operation, an operation of notifying that it is necessary to exclude the cut sheet P2 from the second accommodation part 11*b* (step S4). When it is determined that the printing instruction is not for the roll sheet P1 (step S3: NO), the control unit 10 causes the notification unit 30 to execute, as the notification operation, an operation of notifying that it is necessary to re-roll the roll sheet P1 unrolled from the roll body R (step S5).

After step S4 or step S5, the control unit 10 determines whether the sensor (not shown) has detected insertion/pullout of the feeding tray 11 with respect to the housing 100*a* (step S6). When it is determined that the sensor has detected insertion/pullout of the feeding tray 11 with respect to the housing 100*a* (step S6: YES), the control unit 10 causes the notification unit 30 to stop the predetermined notification operation (step S7), and returns to step S1. Note that, as used herein, the predetermined notification operation is the notification operation of any one of steps S4 and S5, and steps S17, S18, S19 and S21, which will be described later. When it is determined that the sensor has not detected insertion/pullout of the feeding tray 11 with respect to the housing 100*a* (step S6: NO), the control unit 10 causes the notification unit 30 to continuously execute the predetermined notification operation until the sensor detects insertion/pullout of the feeding tray 11 with respect to the housing 100*a*.

In step S2 described above, when it is determined that the cut sheet detection unit 52 has not detected that the cut sheet P2 is accommodated in the second accommodation part 11*b* (S2: NO), the control unit 10 determines whether the sheet presence/absence detection unit 53 has detected that the roll sheet P1 is arranged in the feed position of the feed roller 2 (step S8). When it is determined that the sheet presence/absence detection unit 53 has not detected that the roll sheet P1 is arranged in the feed position of the feed roller 2 (step S8: NO), the control unit 10 determines that the roller sheet P1 is not correctly set. The description "the roller sheet P1 is correctly set" means that the roll sheet P1 unrolled from the roll body R accommodated in the first accommodation part 11*a* is arranged in the feed position of the feed roller 2. The control unit 10 then determines whether the input printing instruction is for the roll sheet P1 (step S16).

When it is determined that the printing instruction is for the roll sheet P1 (step S16: YES), the control unit 10 causes the notification unit 30 to execute, as the notification operation, an operation of notifying that the roll sheet P1 accommodated in the first accommodation part 11*a* is not arranged in the feed position (step S17). Note that, as the notification operation that is executed in step S17, the control unit 30 may notify winding out of the roll sheet P1 to a position on a further downstream side than the position directly under the feed roller 2 in the conveying direction. In the notification operation of step S17, the notification unit 30 may execute, as the notification operation, for example, an operation of notifying that winding out of the roll sheet P1 is insufficient, an operation of notifying that the roll sheet P1 is not arranged in the feed position, an operation of notifying that it is necessary to wind out the roll sheet P1 to the feed position, and the like. Then, the control unit proceeds to step S6 described above. When it is determined that the printing instruction is not for the roll sheet P1 (step S16: NO), the control unit 10 determines that the sheet accommodated in the feeding tray 11 is wrong, and causes the notification unit 30 to execute, as the notification operation, an operation of notifying that it is necessary to re-roll the roll sheet P1 and to set the cut sheet P2 in the second accommodation part (step S18). Then, the control unit proceeds to step S6 described above.

When it is determined that the sheet presence/absence detection unit 53 has detected that the roll sheet P1 is arranged in the feed position of the feed roller 2 (step S8: YES), the control unit 10 determines that the roll sheet P1 unrolled from the roll body R is correctly set. The control unit 10 then determines whether the input printing instruction is for the roll sheet P1 (step S9).

When it is determined that the printing instruction is not for the roll sheet P1 (step S9: NO), the control unit 10 determines that the sheet accommodated in the feeding tray 11 is wrong, and causes the notification unit 30 to execute, as the notification operation, an operation of notifying that it is necessary to re-roll the roll sheet P1 and to set the cut sheet P2 in the second accommodation part (step S18). Then, the control unit proceeds to step S6 described above.

When it is determined that the printing instruction is for the roll sheet P1 (step S9: YES), the control unit 10 drives the feeding motor to start a feeding operation of the roll sheet P1 by the feed roller 2 (step S10). Then, the control unit 10 controls the feeding motor, the intermediate motor, the conveying motor and the sheet discharging motor to convey the roll sheet P1 by a predetermined amount (step S11). Next, the control unit 10 determines whether the roll sheet P1 has been detected by the intermediate register sensor 31 until a first time elapses since the feed roller 2 is driven (step S12). The first time is a time after the feed roller 2 is driven until the roll sheet P1 reaches the intermediate register sensor 31, and is a summed time of an allowable error and a time obtained by dividing a distance along the conveying path from the feed roller 2 to the intermediate register sensor 31 by a feeding speed of the feed roller 2.

When it is determined that the roll sheet P1 has not been detected by the intermediate register sensor 31 until the first time elapses since the feed roller 2 is driven (step S12: NO), the control unit 10 regards that the roll sheet P1 has not reached the intermediate register sensor 31, and causes the notification unit 30 to execute, as the notification operation, an operation of notifying that the roll sheet P1 accommodated in the first accommodation part 11*a* is not appropriately arranged in the feeding tray 11 (step S19). In the notification operation of step S19, the notification unit 30 may execute, as the notification operation, for example, an operation of notifying that it is not possible to feed the roll sheet P1, an operation of notifying that the roll sheet P1 may be arranged in a skewed state, an operation of notifying that it is necessary to appropriately wind out the roll sheet P1 to the feed position, and the like.

When it is determined that the roll sheet P1 has been detected by the intermediate register sensor 31 until the first time elapses since the feed roller 2 is driven (step S12: YES), the control unit 10 determines whether the roll sheet P1 is no longer detected by the intermediate register sensor 31 by a time a second time elapses since the roll sheet P1 is detected by the intermediate register sensor 31 after the drive of the feed roller 2 (step S20). The second time is, for example, in a case where the intermediate register sensor 31 detects the cut sheet P2, a time after the cut sheet P2 starts to be detected until the cut sheet P2 is no longer detected, and is a summed time of an allowable error and a time obtained by dividing a length along the conveying direction of the cut sheet P2 by a conveying speed of the intermediate register sensor 31. That is, when the detected state continues even though the second time elapses since the intermediate register sensor 31 starts detection, the control unit 10 may determine that the roll sheet P1, not the cut sheet P2, is being detected by the intermediate register sensor 31.

When it is determined that the roll sheet P1 is no longer detected by the intermediate register sensor 31 by the time the second time elapses (S20: YES), the control unit 10 regards that the cut sheet P2 may be wrong arranged or the roll sheet P1 may be cut on the way, and causes the notification unit 30 to execute, as the notification operation, an operation of notifying that it is necessary to exclude the cut sheet P2 or the cut roll sheet P1 from the feeding tray 11 (step S21). After step S19 or step S21, the control unit proceeds to step S6 described above.

When it is determined that the state where the roll sheet P1 is detected by the intermediate register sensor 31 is kept even after the second time elapses (S20: NO), the control unit 10 controls the driver IC to performs recording by a predetermined pass (step S13).

Next, the control unit 10 determines whether record data is not present on the same sheet (step S14). When it is determined that record data is present on the same sheet (S14: NO), the control unit returns to step S11. When it is determined that record data is not present on the same sheet (S14: YES), the control unit 10 discharges the roll sheet P1 (step S15), and ends the printing.

In step S1 described above, when it is determined that the roll sheet detection unit 51 has not detected that the roll sheet P1 is accommodated in the first accommodation part 11*a* (S1: NO), the control unit 10 determines whether the cut sheet detection unit 52 has detected that the cut sheet P2 is accommodated in the second accommodation part 11*b* (step S22).

When it is determined that the cut sheet detection unit 52 has detected that the cut sheet P2 is accommodated in the second accommodation part 11*b* (S22: YES), the control unit 10 proceeds to step S28, which will be described later. When it is determined that the cut sheet detection unit 52 has not detected that the cut sheet P2 is accommodated in the second accommodation part 11*b* (S22: NO), the control unit 10 determines that the roll sheet P1 and the cut sheet P2 are not accommodated in the feeding tray 11. The control unit 10 then determines whether the input printing instruction is for the cut sheet P2 (step S23).

When it is determined that the printing instruction is not for the cut sheet P2 (step S23: NO), the control unit 10 causes the notification unit 30 to execute, as the notification operation, an operation of notifying accommodation of the roll body R into the first accommodation part 11*a* and rolling out of the roll sheet P1 from the roll body R (step S24). When it is determined that the printing instruction is for the cut sheet P2 (step S23: YES), the control unit 10 causes the notification unit 30 to execute, as the notification operation, an operation of notifying setting of the cut sheet P2 (step S25).

After step S24 or step S25, the control unit 10 determines whether the sensor (not shown) has detected insertion/pullout of the feeding tray 11 with respect to the housing 100*a* (step S26). When it is determined that the sensor has detected insertion/pullout of the feeding tray 11 with respect to the housing 100*a* (step S26: YES), the control unit 10 causes the notification unit 30 to stop the predetermined notification operation (step S27), and returns to step S1. Note that, as used herein, the predetermined notification operation is the notification operation of any one of steps S24 and S25, and steps S37 and S40, which will be described later. When it is determined that the sensor has not detected insertion/pullout of the feeding tray 11 with respect to the housing 100*a* (step S26: NO), the control unit 10 causes the notification unit 30 to continuously execute the predetermined notification operation until the sensor detects insertion/pullout of the feeding tray 11 with respect to the housing 100*a*.

In step S22 described above, when it is determined that the cut sheet detection unit 52 has detected that the cut sheet P2 is accommodated in the second accommodation part 11*b* (S22: YES), the control unit 10 determines whether the sheet presence/absence detection unit 53 has detected that the cut sheet P2 is arranged in the feed position of the feed roller 2

(step S28). When it is determined that the sheet presence/absence detection unit 53 has not detected that the cut sheet P2 is arranged in the feed position of the feed roller 2 (step S28: NO), the control unit 10 determines that the cut sheet P2 is not correctly set. The description "the cut sheet P2 is correctly set" means that the cut sheet P2 accommodated in the second accommodation part 11*b* is present in a position on a further downstream side than the position directly under the feed roller 2 in the conveying direction. The control unit 10 then determines whether the input printing instruction is for the cut sheet P2 (step S36).

When it is determined that the printing instruction is for the cut sheet P2 (S26: YES), the control unit 10 proceeds to step S26 via step S25 described above. When it is determined that the printing instruction is not for the cut sheet P2 (step S36: NO), the control unit 10 determines that the sheet accommodated in the feeding tray 11 is wrong, and causes the notification unit 30 to execute, as the notification operation, an operation of notifying removal of the cut sheet P2, accommodation of the roll body R and rolling out of the roll sheet P1 (step S37). Then, the control unit proceeds to step S26 described above.

When it is determined that the sheet presence/absence detection unit 53 has detected that the cut sheet P2 is arranged in the feed position of the feed roller 2 (step S28: YES), the control unit 10 determines whether the input printing instruction is for the cut sheet P2 (step S29). When it is determined that the printing instruction is not for the cut sheet P2 (S29: NO), the control unit proceeds to step S26 via step S37 described above. When it is determined that the printing instruction is for the cut sheet P2 (step S29: YES), the control unit 10 drives the feeding motor to start a feeding operation of the cut sheet P2 by the feed roller 2 (step S30). Then, the control unit 10 controls the feeding motor, the intermediate motor, the conveying motor and the sheet discharging motor to convey the cut sheet P2 by a predetermined amount (step S31). Next, the control unit 10 determines whether the intermediate register sensor 31 arranged on the further downstream side than the feed roller 2 in the conveying direction has detected the cut sheet P2 (step S32). Note that, the control unit 10 may execute step S32 after stopping the conveying of the cut sheet P2 or may execute step S32 during the conveying of the cut sheet P2.

When it is determined that the intermediate register sensor 31 has not detected the cut sheet P2 (step S32: NO), the control unit 10 determines that the rear end of the cut sheet P2 has passed through the intermediate register sensor 31. Then, the control unit 10 calculates an unrecorded remaining length of the cut sheet P2 and determines whether the unrecorded remaining length is greater than a recording-required length of the cut sheet P2 on which recording of an image is performed from now (step S38). Note that, the unrecorded remaining length of the cut sheet P2, which is calculated in the present embodiment, is, for example, a length from the intermediate register sensor 31 to the head 5. When the unrecorded remaining length is equal to or smaller than the recording-required length (S38: NO), the control unit 10 determines a size error of the set cut sheet P2, and discharges the cut sheet P2 (step S39). Then, the control unit 10 causes the notification unit 30 to execute, as the notification operation, an operation of notifying setting of the cut sheet P2 (step S40), and proceeds to step S26 described above.

When it is determined that the intermediate register sensor 31 has detected the cut sheet P2 (S32: YES) or when it is determined that the unrecorded remaining length is greater than the recording-required length (S38: YES), the control unit 10 controls the driver IC to perform recording by a predetermined pass (step S33).

Next, the control unit 10 determines whether record data is not present on the same sheet (step S34). When it is determined that record data is present on the same sheet (S34: NO), the control unit returns to step S31. When it is determined that record data is not present on the same sheet (S34: YES), the control unit 10 discharges the cut sheet P2 (step S35), and ends the printing.

As described above, the printer 100 of the first embodiment includes the feeding tray 11 having the first accommodation part 11*a* capable of accommodating the roll body R where the roll sheet P1 is rolled in a roll shape and the second accommodation part 11*b* capable of accommodating the cut sheet P2 in a state of being multiply stacked, the feed roller 2, the head 5, the plurality of detection units, the notification unit 30, and the control unit 10. The control unit 10 is configured to cause the notification unit 30 to execute the notification operation, based on the detections results of the plurality of detection units. According to the present embodiment, it is detected whether the roll sheet P1 or the cut sheet P2 is arranged in the predetermined position in the feeding tray 11, and the notification operation based on the detection result is performed for the user. This allows the user to determine whether the roll sheet P1 or the cut sheet P2 is appropriately arranged in the predetermined position in the feeding tray 11, in the printer 1 having the feeding tray 11 capable of accommodating both the roll body R where the roll sheet P1 is rolled in a roll shape and the cut sheet P2 in a state of being multiply stacked.

In addition, in the present embodiment, the control unit 10 is configured to cause the notification unit 30 to execute the notification operation, based on the detection results by the roll sheet detection unit 51, the cut sheet detection unit 52 and the sheet presence/absence detection unit 53. This allows the user to determine whether the roll sheet P1 or the cut sheet P2 is appropriately arranged in the predetermined position in the feeding tray 11, based on the detection results by the roll sheet detection unit 51, the cut sheet detection unit 52 and the sheet presence/absence detection unit 53.

Further, in the present embodiment, in a case where an instruction for printing on the roll sheet P1 accommodated in the first accommodation part 11*a* is received and the detection result by the roll sheet detection unit 51 indicates that the roll sheet P1 is not accommodated in the first accommodation part 11*a*, the control unit 10 is configured to cause the notification unit 30 to execute, as the notification operation, an operation of notifying rolling out of the roll sheet P1 from the roll body R accommodated in the first accommodation part 11*a*. According to this, even when an instruction for printing on the roll sheet P1 accommodated in the first accommodation part 11*a* is received in a state where the roll sheet P1 is not accommodated in the first accommodation part 11*a*, the printing can be suppressed from being performed, as it is.

Further, in the present embodiment, in a case where an instruction for printing on the cut sheet P2 accommodated in the second accommodation part 11*b* is received and the detection result by the roll sheet detection unit 51 indicates that the roll sheet P1 is accommodated in the first accommodation part 11*a*, the control unit 10 is configured to cause the notification unit 30 to execute, as the notification operation, an operation of notifying that it is necessary to re-roll the roll sheet P1 unrolled from the roll body R. According to this, even when an instruction for printing on the cut sheet P2 accommodated in the second accommodation part 11*b* is received in a state where the roll sheet P1 is accommodated in the first accommodation part 11*b*, the printing can be suppressed from being performed, as it is.

The printer 100 of the present embodiment also includes the intermediate register sensor 31 capable of detecting the roll sheet P1 or the cut sheet P2 in the conveying path. In a case where an instruction for printing on the roll sheet P1 accommodated in the first accommodation part 11*a* is received and the detection result by the roll sheet detection unit 51 indicates that the roll sheet P1 is accommodated in the first accommodation part 11*a*, the control unit 10 is configured to drive the feed roller 2. In a case where the roll sheet P1 is not detected by the intermediate register sensor 31 until the first time elapses since the feed roller 2 is driven, the control unit 10 is configured to cause the notification unit 30 to execute, as the notification operation, an operation of notifying that the roll sheet P1 accommodated in the first accommodation part 11*a* is not appropriately arranged in the feeding tray 11. This allows the user to perceive that the roll sheet P1 accommodated in the first accommodation part 11*a* is not appropriately arranged, when the feeding of the roll sheet P1 by the feed roller 2 is not appropriately performed even though the roll sheet P1 is accommodated in the first accommodation part 11*a*.

Further, in the present embodiment, in a case where the roll sheet P1 is no longer detected by the time the second time elapses since the roll sheet P1 is detected by the intermediate register sensor 31 after the drive of the feed roller 2, the control unit 10 is configured to cause the notification unit 30 to execute, the notification operation, an operation of notifying that it is necessary to exclude the cut sheet P2 from the second accommodation part 11*b*. This allows the user to perceive that it is necessary to exclude the cut sheet P2 from the second accommodation part 11*b*, when the sheet-shaped medium actually fed is the cut sheet P2 accommodated in the second accommodation part 11*b* even though the roll sheet P1 is accommodated in the first accommodation part 11*a*.

Further, in the present embodiment, in a case where an instruction for printing on the roll sheet P1 accommodated in the first accommodation part 11*a* is received and the detection result by the cut sheet detection unit 52 indicates that the cut sheet P2 is accommodated in the second accommodation part 11*b*, the control unit 10 is configured to cause the notification unit 30 to execute, as the notification operation, an operation of notifying that it is necessary to exclude the cut sheet P2 from the second accommodation part 11*b*. When performing printing on the roll sheet P1 accommodated in the first accommodation part 11*a*, if the cut sheet P2 is still accommodated in the second accommodation part 11*b*, the printing cannot be performed as appropriate. According to the above-described configuration, when there is a possibility that the cut sheet P2 is accommodated in the second accommodation part 11*b* at the time of receiving an instruction for printing on the roll sheet P1 accommodated in the first accommodation part 11*a*, it is notified that it is necessary to exclude the cut sheet P2 from the second accommodation part. Therefore, the printing can be suppressed from being performed in a state where the sheet-shaped medium is not appropriately arranged in a predetermined position in the feeding tray 11.

Further, in the present embodiment, in a case where the detection result by the roll sheet detection unit 51 indicates that the roll sheet P1 is accommodated in the first accommodation part 11*a* and the detection result by the sheet presence/absence detection unit 53 indicates that a sheet-shaped medium is not arranged in the feed position, the control unit 10 is configured to cause the notification unit 30 to execute, as the notification operation, an operation of notifying that the roll sheet P1 accommodated in the first accommodation part 11*a* is not arranged in the feed position. This allows the user to perceive that the roll sheet P1 unrolled from the roll body R is not appropriately set in the feed position. Therefore, it is possible to suppress occurrence of situations where the roll sheet P1 set in an inappropriate state is not fed by the feed roller 2 even though the roll body R is accommodated in the first accommodation part 11*a*, a jam is caused in the housing 100*a* after feeding, and the like.

Second Embodiment

In the above-described first embodiment, the printer 100 may not include the cut sheet detection unit 52 and the sheet presence/absence detection unit 53. In the below, a second embodiment of the present disclosure having a configuration where the roll sheet detection unit 51 is included and the cut sheet detection unit 52 and the sheet presence/absence detection unit 53 are not included is described with reference to FIGS. 8A, 8B, 9A and 9B. In descriptions below, the configurations that are similar to the first embodiment are denoted with the same reference signs, and the descriptions thereof are omitted. A printer of the second embodiment has a similar configuration to the printer 100 of the first embodiment, except that the cut sheet detection unit 52 and the sheet presence/absence detection unit 53 are not included.

In the printer of the second embodiment, the distance between the roll sheet detection unit 51 and the feed roller 2 along the conveying path is equal to or greater than the distance between the feed roller 2 and the intermediate roller pair 9 along the conveying path, and is equal to or greater than the distance between the intermediate roller pair 9 and the conveying roller pair 3*a* along the conveying path.

An example of processing, which is executed by the control unit 10 when recording an image on the roll sheet P1 or the cut sheet P2 in the printer of the second embodiment, is described. The processing to be described below is started when the control unit 10 receives a printing instruction.

First, the control unit 10 determines whether the roll sheet detection unit 51 has detected that the roll sheet P1 is accommodated in the first accommodation part 11*a* (step S1). When it is determined that the roll sheet detection unit 51 has not detected that the roll sheet P1 is accommodated in the first accommodation part 11*a* (S101: NO), the control unit 10 proceeds to step S121, which will be described later. When it is determined that the roll sheet detection unit 51 has detected that the roll sheet P1 is accommodated in the first accommodation part 11*a* (step S101: YES), the control unit 10 determines whether the input printing instruction is for the roll sheet P1 (step S102).

When it is determined that the printing instruction is not for the roll sheet P1 (step S102: NO), the control unit 10 determines that the sheet accommodated in the feeding tray 11 is wrong, and causes the notification unit 30 to execute, as the notification Operation, an operation of notifying re-rolling of the roll sheet P1 and setting of the cut sheet P2 (step S103).

The control unit 10 determines whether the sensor (not shown) has detected insertion/pullout of the feeding tray 11 with respect to the housing 100*a* (step S104). When it is determined that the sensor has detected insertion/pullout of the feeding tray 11 with respect to the housing 100*a* (step S104: YES), the control unit 10 stops the predetermined notification operation by the notification unit 30 (step S105), and returns to step S101. Note that, as used herein, the predetermined notification operation is the notification operation of any one of step S103 and steps S109, S114 and S117, which will be described later. When it is determined that the sensor has not detected insertion/pullout of the feeding tray 11 with respect to the housing 100*a* (step S104: NO), the control unit 10 causes the notification unit 30 to continuously perform the predetermined notification operation until the sensor detects insertion/pullout of the feeding tray 11 with respect to the housing 100*a*.

When it is determined that the printing instruction is for the roll sheet P1 (step S102: YES), the control unit 10 drives the feeding motor to start a feeding operation of the roll sheet P1 by the feed roller 2 (step S106). Next, the control unit 10 determines whether the intermediate register sensor 31 arranged on the further downstream side than the feed roller 2 in the conveying direction has detected the roll sheet P1 (step S107).

When it is determined that the intermediate register sensor 31 has not detected the roll sheet P1 (S017: NO), the control unit 10 determines whether a drive amount of the feed roller 2 is equal to or greater than a predetermined threshold value (step S108). Here, the predetermined threshold value is a predetermined threshold value for determining sheet absence of the roll sheet P1, and is set in advance, for example. When it is determined that the drive amount of the feed roller 2 is smaller than the predetermined threshold value (S108: NO), the control unit returns to step S107. When it is determined that the drive amount of the feed roller 2 is equal to or greater than the predetermined threshold value (S108: YES), the control unit 10 determines that the roll sheet P1 is not correctly set, and causes the notification unit 30 to execute, as the notification operation, an operation of notifying rolling out of the roll sheet P1 from the roll body R (step S109). Then, the control unit proceeds to step S104 described above.

When it is determined that the intermediate register sensor 31 has detected the roll sheet P1 (S017: YES), the control unit 10 controls the feeding motor, the intermediate motor, the conveying motor and the sheet discharging motor to convey the roll sheet P1 by a predetermined amount (step S110). Next, the control unit 10 determines whether the roll sheet detection unit 51 has detected that the roll body R is accommodated in the first accommodation part 11*a* (step S111). Note that, the control unit 10 may execute step S111 after stopping the conveying of the roll sheet P1 or may execute step S111 during the conveying of the roll sheet P1.

When it is determined that the roll sheet detection unit 51 has not detected that the roll sheet P1 is accommodated in the first accommodation part 11*a* (step S111: NO), the control unit 10 calculates an unrecorded remaining length of the long-length sheet P1 constituting the roll body R, and determines whether the unrecorded remaining length is greater than a recording-required length of the long-length sheet P1 on which recording of an image is performed from now (step S112). Note that, the unrecorded remaining length of the long-length sheet P1 constituting the roll body R, which is calculated in the present embodiment, is, for example, a length from the roll sheet detection unit 51 to the head 5.

When the unrecorded remaining length is equal to or smaller than the recording-required length (S112: NO), the control unit 10 determines that the long-length sheet P1 constituting the roll body R is out of sheet, and discharges the roll sheet P1 being conveyed (step S113). Then, the control unit 10 causes the notification unit 30 to execute, as the notification operation, an operation of notifying accommodation of a new roll body R and winging out of the roll sheet P1 (step S114), and proceeds to step S104 described above.

When it is determined that the roll sheet detection unit 51 has detected that the roll sheet P1 is accommodated in the first accommodation part 11*a* (S111: YES) or when it is determined that the unrecorded remaining length is greater than the recording-required length (S112: YES), the control unit 10 determines whether the intermediate register sensor 31 has detected the roll sheet P1 (step S115). Note that, whether the intermediate register sensor 31 has detected the roll sheet P1 depends on whether the intermediate register sensor 31 has detected a rear end of a sheet. More specifically, when the cut sheet P2 is being conveyed, the intermediate register sensor 31 is switched from a state of detecting a sheet to a state of not detecting a sheet. At this time, it is determined that the intermediate register sensor 31 has detected the rear end of the cut sheet P2, that is, has not detected the roll sheet P1. On the other hand, when the roll sheet P1 is being conveyed, the intermediate register sensor 31 remains in the state of detecting a sheet. At this time, it is determined that the intermediate register sensor 31 has not detected the rear end of the cut sheet P2, that is, has detected the roll sheet P1.

When it is determined that the intermediate register sensor 31 has not detected the roll sheet P1 (S115: NO), the control unit 10 determines that the cut sheet P2 is wrong set, and discharges the cut sheet P2 being conveyed (step S116). Then, the control unit 10 causes the notification unit 30 to execute, as the notification operation, an operation of notifying removal of the cut sheet P2 from the second accommodation part 11*b* (step S117), and proceeds to step S104 described above.

When it is determined that the intermediate register sensor 31 has detected the roll sheet P1 (S115: YES), the control unit 10 controls the driver IC to perform recording by a predetermined pass (step S118).

Next, the control unit 10 determines whether record data is not present on the same sheet (step S119). When it is determined that record data is present on the same sheet (S119: NO), the control unit returns to step S110. When it is determined that record data is not present on the same sheet (S119: YES), the control unit 10 discharges the roll sheet P1 (step S120), and ends the printing.

In step S101 described above, when it is determined that the roll sheet detection unit 51 has not detected that the roll sheet P1 is accommodated in the first accommodation part 11*a* (S101: NO), the control unit 10 determines that the cut sheet P2 is set in the feeding tray 11 or neither the roll sheet P1 nor the cut sheet P2 is accommodated. The control unit 10 then determines whether the input printing instruction is for the cut sheet P2 (step S121).

When it is determined that the printing instruction is not for the cut sheet P2 (step S121: NO), the control unit 10 determines that the sheet accommodated in the feeding tray 11 is wrong, and causes the notification unit 30 to execute, as the notification operation, an operation of notifying removal of the cut sheet P2, accommodation of the roll body R and rolling out of the roll sheet P1 (step S122).

Next, the control unit 10 determines whether the sensor (not shown) has detected insertion/pullout of the feeding tray 11 with respect to the housing 100*a* (step S123). When it is determined that the sensor has detected insertion/pullout of the feeding tray 11 with respect to the housing 100*a* (step S123: YES), the control unit 10 stops the predetermined notification by the notification unit 30 (step S124), and returns to step S101. Note that, as used herein, the predetermined notification operation is the notification operation of any one of step S122, and steps S128 and S133, which will be described later. When it is determined that the sensor has not detected insertion; pullout of the feeding tray 11 with respect to the housing 100*a* (step S123: NO), the control unit 10 causes the notification unit 30 to continuously perform the predetermined notification operation until the sensor detects insertion/pullout of the feeding tray 11 with respect to the housing 100*a*.

When it is determined that the printing instruction is for the cut sheet P2 (step S121: YES), the control unit 10 drives the feeding motor to start a feeding operation of the cut sheet P2 by the feed roller 2 (step S125). Next, the control unit 10 determines whether the intermediate register sensor 31 arranged on the further downstream side than the feed roller 2 in the conveying direction has detected the front end of the cut sheet P2 (step S126).

When it is determined that the intermediate register sensor 31 has not detected the front end of the cut sheet P2 (S126: NO), the control unit 10 determines whether a drive amount of the feed roller 2 is equal to or greater than a predetermined threshold value (step S127). Here, the predetermined threshold value is a predetermined threshold value for determining sheet absence of the cut sheet P2, and is set in advance, for example. When it is determined that the drive amount of the feed roller 2 is smaller than the predetermined threshold value (S127: NO), the control unit returns to step S126. When it is determined that the drive amount of the feed roller 2 is equal to or greater than the predetermined threshold value (S127: YES), the control unit 10 determines that the cut sheet P2 is not correctly set or neither the roll body R nor the cut sheet P2 is accommodated, and causes the notification unit 30 to execute, as the notification operation, an operation of notifying setting of the cut sheet P2 (step S128). Then, the control unit proceeds to step S123 described above.

When it is determined that the intermediate register sensor 31 has detected the front end of the cut sheet P2 (S126: YES), the control unit 10 controls the feeding motor, the intermediate motor, the conveying motor and the sheet discharging motor to convey the cut sheet P2 by a predetermined amount (step S129). Next, the control unit 10 determines whether the intermediate register sensor 31 has detected the cut sheet P2 (step S130). Note that, the control unit 10 may execute step S130 after stopping the conveying of the cut sheet P2 or may execute step S130 during the conveying of the cut sheet P2.

When it is determined that the intermediate register sensor 31 has not detected the cut sheet P2 (step S130: NO), the control unit 10 determines that the rear end of the cut sheet P2 has passed through the intermediate register sensor 31. Then, the control unit 10 calculates an unrecorded remaining length of the cut sheet P2 and determines whether the unrecorded remaining length is greater than a recording-required length of the cut sheet P2 on which recording of an image is performed from now (step S131). Note that, the unrecorded remaining length of the cut sheet P2, which is calculated in the present embodiment, is, for example, a length from the intermediate register sensor 31 to the head 5. When the unrecorded remaining length is equal to or smaller than the recording-required length (S131: NO), the control unit 10 determines a size error of the set cut sheet P2, and discharges the cut sheet P2 (step S132). Then, the control unit 10 causes the notification unit 30 to execute, as the notification operation, an operation of notifying setting of the cut sheet P2 (step S133), and proceeds to step S123 described above.

When it is determined that the intermediate register sensor 31 has detected the cut sheet P2 (S130: YES) or when it is determined that the unrecorded remaining length is greater than the recording-required length (S131: YES), the control unit 10 controls the driver IC to perform recording by a predetermined pass (step S134).

Next, the control unit 10 determines whether record data is not present on the same sheet (step S135). When it is determined that record data is present on the same sheet (S135: NO), the control unit returns to step S129. When it is determined that record data is not present on the same sheet (S135: YES), the control unit 10 discharges the cut sheet P2 (step S136), and ends the printing.

As described above, the printer of the second embodiment includes the roll sheet detection unit 51. This allows the user to determine whether the sheet-shaped medium is appropriately arranged in the predetermined position in the feeding tray, based on the detection result as to whether the roll sheet P1 is accommodated in the first accommodation part 11*a*.

In addition, in the printer of the second embodiment, the distance between the roll sheet detection unit 51 and the feed roller 2 along the conveying path is equal to or greater than the distance between the feed roller 2 and the intermediate roller pair 9 along the conveying path, and is equal to or greater than the distance between the intermediate roller pair 9 and the conveying roller pair 3*a* along the conveying path. For example, in a state where the remaining amount of the roll body R accommodated in the first accommodation part 11*a* is small, an edge of the rear end of the roll sheet P1 sent from the first accommodation part 11*a* to the feed roller 2 may be detected by the roll sheet detection unit 51. The roll body R detected by the roll sheet detection unit 51 and sent to the feed roller 2 is conveyed, as it is. In this case, if the distance between the intermediate roller pair 9 and the conveying roller pair 3*a* or the distance between the feed roller 2 and the intermediate roller pair 9 is greater than the distance between the roll sheet detection unit 51 and the feed roller 2, the roll sheet P1 being conveyed cannot reach a next roller from a roller and stays between the two rollers. According to the configuration of the present embodiment, it is possible to avoid the above problem and to securely convey the roll sheet P1, which is delivered from the first accommodation part 11*a*, along the conveying path.

Preferably, the distance between the roll sheet detection unit 51 and the sheet presence/absence detection unit 53 along the conveying path is equal to or greater than the distance between the feed roller 2 and the intermediate roller pair 9 along the conveying path, and is equal to or greater than the distance between the intermediate roller pair 9 and the conveying roller pair 3*a* along the conveying path. According to this configuration, it is possible to securely convey the roll sheet P1, which is delivered from the first accommodation part 11*a*, along the conveying path.

Modified Embodiments

Although the preferred embodiments of the present disclosure have been described, the present invention is not limited to the above-described embodiments, and can be variously changed within the claims.

The printer 100 of the above-described first embodiment includes the roll sheet detection unit 51, the cut sheet detection unit 52, and the sheet presence/absence detection unit 53. In addition, the printer of the above-described second embodiment includes only the roll sheet detection unit 51 among the roll sheet detection unit 51, the cut sheet detection unit 52 and the sheet presence/absence detection unit 53. However, the printer of the present disclosure may include only any one of the roll sheet detection unit 51, the cut sheet detection unit 52 and the sheet presence/absence detection unit 53 or may include a combination of any two detection units. For example, the printer may include only the cut sheet detection unit 52 and the sheet presence/absence detection unit 53 of the roll sheet detection unit 51, the cut sheet detection unit 52 and the sheet presence/absence detection unit 53. In this case, the control unit 10 is configured to cause the notification unit 30 to execute the notification operation, based on the detection results by the cut sheet detection unit 52 and the sheet presence/absence detection unit 53. This allows the user to determine whether the sheet-shaped medium is appropriately arranged in the predetermined position in the feeding tray 11, based on the detection results by the cut sheet detection unit 52 and the sheet presence/absence detection unit 53.

In addition, in the printer configured to include only the roll sheet detection unit 51 and the sheet presence/absence detection unit 53 among the roll sheet detection unit 51, the cut sheet detection unit 52 and the sheet presence/absence detection unit 53, when the roll sheet detection unit 51 does not detect the roll sheet P1, it is determined that the cut sheet P2 is accommodated in the feeding tray 11 or neither the roll sheet P1 nor the cut sheet P2 is accommodated. In this case, the determination as to whether the cut sheet P2 is correctly set depends on, for example, whether the intermediate register sensor 31 arranged on the further downstream side than the feed roller 2 in the conveying direction has detected the cut sheet P2, after the feeding operation is started.

In a case where the sheet presence/absence detection unit 53 is not arranged in the printer of the present disclosure, the determination as to whether the roll sheet P1 or the cut sheet P2 is present in the position directly under the feed roller 2, i.e., is correctly set may be performed as follows, for example. For example, it is determined whether the roll sheet P1 or the cut sheet P2 is correctly set, depending on whether the roll sheet P1 unrolled from the roll body R accommodated in the feeding tray 11 or the cut sheet P2 is detected by the intermediate register sensor 31 arranged on the further downstream side than the feed roller 2 in the conveying direction, after start of the feeding operation. Alternatively, it may be determined whether the roll sheet P1 or the cut sheet P2 is correctly set by detecting current that occurs in the feeding motor (not shown) configured to drive rotation of the feed roller 2. In a case where the roll sheet P1 or the cut sheet P2 is not correctly set, the feed roller 2 comes into contact with the bottom surface of the feeding tray 11. In this case, the feed roller 2 cannot rotate and is locked, and the maximum current flows in the feeding motor. By detecting current at this time, it is possible to determine whether the roll sheet P1 or the cut sheet P2 is correctly set.

In the above-described embodiments, the roll sheet detection unit 51, the cut sheet detection unit 52, and the sheet presence/absence detection unit 53 consist of the actuator and the photo sensor. However, each detection unit may not have the actuator, may be a photo sensor having the light-emitting element and the light-receiving element, and may be configured to directly detect a sheet by irradiating a light beam to the sheet. In this case, the light-emitting element and the light-receiving element are attached to the housing. In addition, a sensor configured to detect presence or absence of a sheet as an actuator pushed due to contact with the sheet comes into contact with a switch or the like is also possible.

In the above-described embodiments, the sheet presence/absence detection unit 53 is configured to detect whether the roll sheet P1 or the cut sheet P2 is present in the position on the further downstream side than the position directly under the feed roller 2 in the conveying direction. However, the sheet presence/absence detection unit 53 may also be configured to detect whether the roll sheet P1 or the cut sheet P2 is present in the position directly under the feed roller 2.

In the above-described first embodiment and second embodiment, the feeding tray can be inserted/pulled out in the front and rear direction with respect to the housing. However, the feeding tray may also be configured to be inserted/pulled out in the right and left direction with respect to the housing.

The image forming apparatus of the present disclosure can also be applied to a complex machine, a copier and the like, in addition to the printer 100. In addition, the printer is not limited to the inkjet type and may also be a laser type. Further, the sheet-shaped medium of the present disclosure may also be a cloth, a label or the like, in addition to the sheet.

In the above-described first embodiment, in a case where the detection result by the roll sheet detection unit 51 indicates that the roll sheet P1 is not accommodated in the first accommodation part 11*a*, the detection result by the cut sheet detection unit 52 indicates that the cut sheet P2 is not accommodated in the second accommodation part 11*b* and the detection result by the sheet presence/absence detection unit 53 indicates that the sheet-shaped medium is arranged in the feed position, the control unit 10 may be configured to cause the notification unit 30 to execute, as the notification operation, an operation of notifying that it is necessary to exclude a shred of the roll sheet P1 remaining in the feed position from the feeding tray 11. When performing printing on the roll sheet P1 unrolled from the roll body R, the roll sheet P1 is cut into an appropriate length. A shred of the cut roll sheet P1 may remain in the feeding tray 11. According to the above-described configuration, it is possible to detect the shred of the roll sheet P1 remaining in the feeding tray 11. In addition, it is possible to notify the user that it is necessary to exclude the shred. Note that, a timing at which the control unit 10 causes the notification unit 30 to execute the operation of notifying that it is necessary to exclude a shred of the roll sheet P1 remaining in the feed position from the feeding tray 11 may be at the time of inserting the feeding tray 11 into the housing 100*a*. In addition, the timing may be any timing before the printing instruction is received, may be after the printing instruction is received or may be after the feeding operation by the feed roller 2 starts. Further, at all the timings described above, the control unit 10 may be configured to cause the notification unit 30 to execute the operation of notifying that it is necessary to exclude a shred of the roll sheet P1 remaining in the feed position from the feeding tray 11.

In the present disclosure, in a case where the detection result by the roll sheet detection unit 51 indicates that the roll sheet P1 is accommodated in the first accommodation part 11*a* and the detection result by the cut sheet detection unit 52 indicates that the cut sheet P2 is accommodated in the second accommodation part 11*b*, before receiving an instruction for printing on a sheet-shaped medium, the control unit 10 may be configured to cause the notification unit 30 to execute, as the notification operation, an operation of notifying that the cut sheet P2 accommodated in the second accommodation part 11*b* is to be fed. This allows the user to perceive that the cut sheet P2 accommodated in the second accommodation part 11*b* is to be fed at the time of feeding by the feed roller 2, before receiving an instruction for printing on a sheet-shaped medium. Therefore, it is possible to determine whether it is necessary to remove the sheet-shaped medium from the second accommodation part 11*b* at the stage before start of the feeding operation by the feed roller 2.

In the present disclosure, in a case where the detection result by the roll sheet detection unit 51 indicates that the roll sheet P1 is not accommodated in the first accommodation part 11*a* and the detection result by the cut sheet detection unit 52 indicates that the cut sheet P2 is not accommodated in the second accommodation part 11*b*, the control unit 10 may be configured to cause the notification unit 30 to execute, as the notification operation, an operation of notifying that the sheet-shaped medium is accommodated in neither the first accommodation part 11*a* nor the second accommodation part 11*b*. This allows the user to perceive that the sheet-shaped medium is not arranged in the feeding tray 11. Note that, a timing at which the control unit 10 causes the notification unit 30 to execute, as the notification operation, the operation of notifying that the sheet-shaped medium is accommodated in neither the first accommodation part 11*a* nor the second accommodation part 11*b* may be at the time of inserting e feeding tray 11 into the housing 100*a*. In addition, the timing may be any timing before the printing instruction is received, may be after the printing instruction is received or may be after the feeding operation by the feed roller 2 starts. Further, at all the timings described above, the control unit 10 may be configured to cause the notification unit 30 to execute, as the notification operation, the operation of notifying that the sheet-shaped medium is accommodated in neither the first accommodation part 11*a* nor the second accommodation part 11*b*.

In the present disclosure, a timing at which, in a case where the detection result by the roll sheet detection unit 51 indicates that the roll sheet P1 is accommodated in the first accommodation part 11*a* and the detection result by the sheet presence/absence detection unit 53 indicates that a sheet-shaped medium is not arranged in the feed position, the control unit 10 causes the notification unit 30 to execute, as the notification operation, an operation of notifying that the roll sheet P1 accommodated in the first accommodation part 11*a* is not arranged in the feed position may be at the time of inserting the feeding tray 11 into the housing 100*a*. In addition, the timing may be any timing before the printing instruction is received, may be after the printing instruction is received or may be after the feeding operation by the feed roller 2 starts. Further, at all the timings described above, the control unit 10 may be configured to cause the notification unit 30 to execute, as the notification operation, the operation of notifying that the roll sheet P1 accommodated in the first accommodation part 11*a* is not arranged in the feed position.

In the present disclosure, the case where "the detection result does not indicate that the sheet-shaped medium is accommodated in the first accommodation part" is not limited to a case where the roll sheet detection unit 51 directly detects that the roll sheet P1 is not accommodated in the first accommodation part 11*a*. For example, in a printer where the roll sheet detection unit 51 is not arranged, it is not possible to assert, from the detection result of the detection unit except the roll sheet detection unit 51, that it "indicates that the sheet-shaped medium is accommodated in the first accommodation part". Therefore, the detection result of the detection unit except the roll sheet detection unit 51 is also included in the case where "the detection result does not indicate that the sheet-shaped medium is accommodated in the first accommodation part".

In the present disclosure, the case where "the detection result does not indicate that the sheet-shaped medium is not accommodated in the first accommodation part" is not limited to a case where the roll sheet detection unit 51 directly detects that the roll sheet P1 is accommodated in the first accommodation part 11*a*. For example, in a printer where the roll sheet detection unit 51 is not arranged, it is not possible to assert, from the detection result of the detection unit except the roll sheet detection unit 51, that it 'indicates that the sheet-shaped medium is not accommodated in the first accommodation part". Therefore, the detection result of the detection unit except the roll sheet detection unit 51 is also included in the case where "the detection result does not indicate that the sheet-shaped medium is not accommodated in the first accommodation part".

In the present disclosure, the case where "the detection result does not indicate that the sheet-shaped medium is accommodated in the second accommodation part" is not limited to a case where the cut sheet detection unit 52 directly detects that the cut sheet P2 is not accommodated in the second accommodation part 11*b*. For example, in a printer where the cut sheet detection unit 52 is not arranged, it is not possible to assert, from the detection result of the detection unit except the cut sheet detection unit 52, that it 'indicates that the sheet-shaped medium is accommodated in the second accommodation part". Therefore, the detection result of the detection unit except the cut sheet detection unit 52 is also included in the case where "the detection result does not indicate that the sheet-shaped medium is accommodated in the second accommodation part".

In the present disclosure, the case where "the detection result does not indicate that the sheet-shaped medium is not accommodated in the second accommodation part" is not limited to a case where the cut sheet detection unit 52 directly detects that the cut sheet P2 is accommodated in the second accommodation part 11*b*. For example, in a printer where the cut sheet detection unit 52 is not arranged, it is not possible to assert, from the detection result of the detection unit except the cut sheet detection unit 52, that it 'indicates that the sheet-shaped medium is not accommodated in the second accommodation part." Therefore, the detection result of the detection unit except the cut sheet detection unit 52 is also included in the case where "the detection result does not indicate that the sheet-shaped medium is not accommodated in the second accommodation part".

In the present disclosure, "the operation of notifying a content pertaining to arrangement of the sheet-shaped medium accommodated in the first accommodation part with respect to the feeding tray" includes an operation of notifying rolling out of the roll sheet P1 from the roll body R, an operation of notifying that the roll sheet P1 is not accommodated in the first accommodation part 11*a*, an operation of notifying that it is necessary to appropriately set the roll sheet P1 in the first accommodation part 11*a*, an operation of notifying that it is necessary to exclude a shred of the roll sheet P1, and the like.

In the present disclosure, "the operation of notifying a content pertaining to arrangement of the sheet-shaped medium accommodated in the second accommodation part with respect to the feeding tray" includes an operation of notifying that it is necessary to set the cut sheet P2 in the second accommodation part, an operation of notifying that the cut sheet P2 is not accommodated in the second accommodation part 11*b*, an operation of notifying that it is necessary to appropriately set the cut sheet P2 in the second accommodation part 11*b*, and the like.

The image forming apparatus of the present disclosure includes control where, based on the detection results by one or more detection units, the control unit 10 causes the notification unit 30 to execute the notification operation for a certain detection result and causes the notification unit 30 not to execute the notification operation for another detection result.

The printer 100 of the above-described embodiments has the configuration where the roll sheet P1 cannot be fed by the feed roller 2 in a case where the cut sheet P2 is accommodated in the second accommodation part 11*b*, when printing the roll sheet P1. However, the image forming apparatus of the present disclosure may also be configured to feed the roll sheet P1 and the cut sheet P2 to different feeding paths by different feed rollers. That is, in the case of this configuration, in a state where both the roll sheet P1 and the cut sheet P2 are accommodated in the feeding tray, the roll sheet P1 and the cut sheet P2 can be each fed. Even with this configuration, the control unit 10 causes the notification unit 30 to execute the notification operation, based on detection results of one or more detection units capable of detecting whether the sheet-shaped medium is arranged in the predetermined position in the feeding tray.

What is claimed is:

1. An image forming apparatus comprising:

a housing;

a feeding tray capable of being inserted into and pulled out from the housing, and including a first accommodation part in which a roll body having a configuration where a sheet-shaped medium is rolled in a roll shape is accommodated and a second accommodation part in which a plurality of sheet-shaped media are accommodated in a state of being stacked;

a feed roller configured to feed a sheet-shaped medium from the feeding tray toward a conveying path;

an image forming unit configured to form an image on a sheet-shaped medium provided in the conveying path; and one or more detection units configured to detect whether a sheet-shaped medium is arranged in a predetermined position in the feeding tray.

2. The image forming apparatus according to claim 1, further comprising:

a notification unit configured to execute a notification operation of issuing a notification to a user of the image forming apparatus; and a control unit configured to cause the notification unit to execute the notification operation, based on a detection result by the one or more detection units.

3. The image forming apparatus according to claim 2, wherein the control unit is configured to cause the notification unit to:

execute, as the notification operation, an operation of notifying a content pertaining to an arrangement of a sheet-shaped medium accommodated in the first accommodation part with respect to the feeding tray, in a case where an instruction for printing on a sheet-shaped medium accommodated in the first accommodation part is received and the detection result does not indicate that a sheet-shaped medium is accommodated in the first accommodation part; and execute, as the notification operation, an operation of notifying a content pertaining to an arrangement of a sheet-shaped medium accommodated in the second accommodation part with respect to the feeding tray, in a case where an instruction for printing on a sheet-shaped medium accommodated in the second accommodation part is received and the detection result does not indicate that a sheet-shaped medium is accommodated in the second accommodation part.

4. The image forming apparatus according to claim 2, wherein the control unit is configured to cause the notification unit to execute, as the notification operation, an operation of notifying that it is necessary to exclude a sheet-shaped medium from the second accommodation part, in a case where an instruction for printing on a sheet-shaped medium accommodated in the first accommodation part is received and the detection result does not indicate that a sheet-shaped medium is not accommodated in the second accommodation part.

5. The image forming apparatus according to claim 2, wherein the control unit is configured to cause the notification unit to execute, as the notification operation, an operation of notifying that it is necessary to re-roll a sheet-shaped medium unrolled from the roll body, in a case where an instruction for printing on a sheet-shaped medium accommodated in the second accommodation part is received and the detection result does not indicate that a sheet-shaped medium is not accommodated in the first accommodation part.

6. The image forming apparatus according to claim 2, wherein the one or more detection units include a first detection unit configured to detect whether a sheet-shaped medium is accommodated in the first accommodation part of the feeding tray, and the control unit is configured to cause the notification unit to execute the notification operation, based on a detection result by the first detection unit.

7. The image forming apparatus according to claim 6, wherein the control unit is configured to cause the notification unit to execute, as the notification operation, an operation of notifying a content pertaining to an arrangement of a sheet-shaped medium accommodated in the first accommodation part with respect to the feeding tray, in a case where an instruction for printing on a sheet-shaped medium accommodated in the first accommodation part is received and the detection result by the first detection unit indicates that a sheet-shaped medium is not accommodated in the first accommodation part.

8. The image forming apparatus according to claim 6, wherein the control unit is configured to cause the notification unit to execute, as the notification operation, an operation of notifying that it is necessary to re-roll a sheet-shaped medium unrolled from the roll body, in a case where an instruction for printing on a sheet-shaped medium accommodated in the second accommodation part is received and the detection result by the first detection unit indicates that a sheet-shaped medium is accommodated in the first accommodation part.

9. The image forming apparatus according to claim 6, further comprising:

a conveying detection unit configured to detect a sheet-shaped medium in the conveying path, wherein the control unit is configured to:

drive the feed roller, in a case where an instruction for printing on a sheet-shaped medium accommodated in the first accommodation part is received and the detection result by the first detection unit indicates that a sheet-shaped medium is accommodated in the first accommodation part; and cause the notification unit to execute, as the notification operation, an operation of notifying that a sheet-shaped medium accommodated in the first accommodation part is not appropriately arranged in the feeding tray, in a case where a sheet-shaped medium is not detected by the conveying detection unit until a first time elapses since the feed roller is driven.

10. The image forming apparatus according to claim 6, further comprising:

a conveying detection unit configured to detect a sheet-shaped medium in the conveying path, wherein the control unit is configured to:

drive the feed roller, in a case where an instruction for printing on a sheet-shaped medium accommodated in the first accommodation part is received and the detection result by the first detection unit indicates that a sheet-shaped medium is accommodated in the first accommodation part; and cause the notification unit to execute, as the notification operation, an operation of notifying that it is necessary to exclude a sheet-shaped medium from the second accommodation part, in a case where a sheet-shaped medium is no longer detected by the conveying detection unit by a time a second time elapses since a sheet-shaped medium is detected by the conveying detection unit after the feed roller is driven.

11. The image forming apparatus according to claim 6, wherein the one or more detection units further include a second detection unit configured to detect whether a sheet-shaped medium is accommodated in the second accommodation part of the feeding tray, and the control unit is configured to cause the notification unit to execute the notification operation, based on detection results by the first detection unit and the second detection unit.

12. The image forming apparatus according to claim 11, wherein the control unit is configured to cause the notification unit to execute, as the notification operation, an operation of notifying that it is necessary to exclude a sheet-shaped medium from the second accommodation part, in a case where an instruction for printing on a sheet-shaped medium accommodated in the first accommodation part is received and the detection result by the second detection unit indicates that a sheet-shaped medium is accommodated in the second accommodation part.

13. The image forming apparatus according to claim 11, wherein the control unit is configured to cause the notification unit to execute, as the notification operation, an operation of notifying that a sheet-shaped medium is accommodated in neither the first accommodation part nor the second accommodation part, in a case where the detection result by the first detection unit indicates that a sheet-shaped medium is not accommodated in the first accommodation part and the detection result by the second detection unit indicates that a sheet-shaped medium is not accommodated in the second accommodation part.

14. The image forming apparatus according to claim 11, wherein the control unit is configured to cause the notification unit to execute, as the notification operation, an operation of notifying that a sheet-shaped medium accommodated in the second accommodation part is to be fed, before an instruction for printing on a sheet-shaped medium is received, in a case where the detection result by the first detection unit indicates that a sheet-shaped medium is accommodated in the first accommodation part and the detection result by the second detection unit indicates that a sheet-shaped medium is accommodated in the second accommodation part.

15. The image forming apparatus according to claim 6, wherein the one or more detection units further include a third detection unit configured to detect whether a sheet-shaped medium is arranged in a feed position where the feed roller enables to feed a sheet-shaped medium, and the control unit is configured to cause the notification unit to execute the notification operation, based on detection results by the first detection unit and the third detection unit.

16. The image forming apparatus according to claim 15, wherein the control unit is configured to cause the notification unit to execute, as the notification operation, an operation of notifying that a sheet-shaped medium accommodated in the first accommodation part is not arranged in the feed position, in a case where the detection result by the first detection unit indicates that a sheet-shaped medium is accommodated in the first accommodation part and the detection result by the third detection unit indicates that a sheet-shaped medium is not arranged in the feed position.

17. The image forming apparatus according to claim 11, wherein the one or more detection units further include a third detection unit configured to detect whether a sheet-shaped medium is arranged in a feed position where the feed roller enables to feed a sheet-shaped medium, and the control unit is configured to cause the notification unit to execute the notification operation, based on detection results by the first detection unit, the second detection unit and the third detection unit.

18. The image forming apparatus according to claim 17, wherein the control unit is configured to cause the notification unit to execute, as the notification operation, an operation of notifying that it is necessary to exclude a shred of a sheet-shaped medium remaining in the feed position from the feeding tray, in a case where the detection result by the first detection unit indicates that a sheet-shaped medium is not accommodated in the first accommodation part, the detection result by the second detection unit indicates that a sheet-shaped medium is not accommodated in the second accommodation part, and the detection result by the third detection unit indicates that a sheet-shaped medium is arranged in the feed position.

19. The image forming apparatus according to claim 2, wherein the one or more detection units include:

a second detection unit configured to detect whether a sheet-shaped medium is accommodated in the second accommodation part of the feeding tray; and a third detection unit configured to detect whether a sheet-shaped medium is arranged in a feed position where the feed roller enables to feed a sheet-shaped medium, and the control unit is configured to cause the notification unit to execute the notification operation, based on detection results by the second detection unit and the third detection unit.

20. The image forming apparatus according to claim 6, further comprising:

an intermediate roller arranged between the feed roller and the image forming unit on the conveying path; and a conveying roller arranged between the intermediate roller and the image forming unit on the conveying path, wherein a distance between the first detection unit and the feed roller along the conveying path is equal to or greater than a distance between the feed roller and the intermediate roller along the conveying path and is equal to or greater than a distance between the intermediate roller and the conveying roller along the conveying path.

21. The image forming apparatus according to claim 15, wherein the feed position is a position on a further downstream side than the first detection unit in a conveying direction along the conveying path, and directly under the feed roller or on a further downstream side than a position directly under the feed roller in the conveying direction.

22. The image forming apparatus according to claim 15, further comprising:

an intermediate roller arranged between the feed roller and the image forming unit on the conveying path; and a conveying roller arranged between the intermediate roller and the image forming unit on the conveying path, wherein a distance between the first detection unit and the third detection unit along the conveying path is equal to or greater than a distance between the feed roller and the intermediate roller along the conveying path and is equal to or greater than a distance between the intermediate roller and the conveying roller along the conveying path.

23. The image forming apparatus according to claim 21, wherein the third detection unit is arranged on a further downstream side than a position directly under the feed roller in a conveying direction along the conveying path.

* * * * *